US006427663B1

(12) United States Patent
Breeden

(10) Patent No.: US 6,427,663 B1
(45) Date of Patent: Aug. 6, 2002

(54) INLET THROTTLE PUMP ASSEMBLY FOR DIESEL ENGINE AND METHOD

(76) Inventor: Robert H. Breeden, 732 Beechwood Dr., Wooster, OH (US) 44691-2747

( * ) Notice: Subject to any disclaimer, the term of this patent is extended or adjusted under 35 U.S.C. 154(b) by 46 days.

(21) Appl. No.: 09/733,479

(22) Filed: Dec. 8, 2000

(51) Int. Cl.[7] ..... F02M 37/04; F04B 49/00
(52) U.S. Cl. ..... 123/446; 417/292
(58) Field of Search ..... 123/446, 447; 417/440, 441, 292, 279

(56) References Cited

U.S. PATENT DOCUMENTS

| | | | | |
|---|---|---|---|---|
| 1,945,452 A | | 1/1934 | Sidney | 417/494 |
| 1,948,047 A | | 2/1934 | Retel | 417/289 |
| 1,974,851 A | | 9/1934 | Hurst | 123/459 |
| 2,101,226 A | | 12/1937 | Sonntag | 417/286 |
| 2,102,117 A | | 12/1937 | Goldberg | 417/569 |
| 2,281,302 A | | 4/1942 | Amery | 210/108 |
| 2,297,234 A | | 9/1942 | Meiswinkel | 417/295 |
| 2,357,870 A | | 9/1944 | Beeh | 417/251 |
| 2,440,194 A | | 4/1948 | Juhasz et al. | 417/289 |
| 2,594,132 A | | 4/1952 | Dalrymple | 251/28 |
| 2,657,631 A | | 11/1953 | Evans | 417/289 |
| 2,691,388 A | | 10/1954 | Livers | 137/505 |
| 2,732,805 A | | 1/1956 | Lucien | 417/270 |
| 3,096,716 A | | 7/1963 | Chmura | 417/292 |
| RE25,553 E | | 4/1964 | Budzich | 417/289 |
| 3,183,848 A | | 5/1965 | Raymond | 417/269 |
| 3,519,370 A | | 7/1970 | Bleuel | 417/273 |
| 3,771,917 A | | 11/1973 | Davies | 417/289 |
| 3,772,889 A | | 11/1973 | Mason et al. | 60/473 |
| 3,834,838 A | | 9/1974 | Indra | 417/490 |
| 4,273,516 A | | 6/1981 | Farr | 417/214 |
| 4,371,317 A | | 2/1983 | Heibel | 417/298 |
| 4,431,381 A | | 2/1984 | Falendysz et al. | 417/289 |
| 4,741,675 A | | 5/1988 | Bowden | 417/295 |
| RE32,965 E | | 6/1989 | Schmid | 123/503 |
| 4,911,615 A | | 3/1990 | McCullagh | 417/295 |
| 5,957,674 A | | 9/1999 | Zenmei et al. | 417/505 |
| 6,035,828 A | * | 3/2000 | Anderson et al. | 123/446 |
| 6,135,090 A | | 10/2000 | Kawachi et al. | 123/446 |
| 6,149,073 A | | 11/2000 | Hickey et al. | 239/89 |
| 6,152,107 A | | 11/2000 | Barnes et al. | 123/357 |
| 6,216,670 B1 | * | 4/2001 | Anderson et al. | 123/446 |
| 6,222,167 B1 | * | 5/2001 | Smith et al. | 123/446 |

FOREIGN PATENT DOCUMENTS

GB 706863 4/1954

OTHER PUBLICATIONS

Exhibit A—Drawing from Nippondenso patent document earlier than Jun. 1996.
Drawing from Navistar International Service Manual earlier than Dec. 8, 2000.

* cited by examiner

*Primary Examiner*—Tony M. Argenbright
(74) *Attorney, Agent, or Firm*—Thomas Hooker, P.C.

(57) ABSTRACT

A pump assembly flows pressurized engine oil to HEUI fuel injectors in a diesel engine. The assembly includes an inlet throttle valve which controls the volume of oil flowed to the pump dependent upon the difference between the pump outlet pressure and a desired outlet pressure determined by an electronic control module for the diesel engine. When the engine is cold a valve opens to assure flow of cold oil to the pump.

25 Claims, 12 Drawing Sheets

INLET THROTTLE PUMP ASSEMBLY FOR DIESEL ENGINE AND METHOD

FIELD OF THE INVENTION

The invention relates to pump assemblies and pumping methods for diesel engines having Hydraulic Electronic Unit Injector (HEUI) fuel systems.

DESCRIPTION OF THE PRIOR ART

Diesel engines using HEUI fuel injectors are well known. A HEUI injector includes an actuation solenoid which, in response to a signal from the diesel engine electronic control module, opens a valve for an interval to permit high pressure engine oil supplied to the injector to extend a fuel plunger and inject fuel into the combustion chamber.

HEUI injectors are actuated by oil drawn from the sump of the diesel engine by the diesel engine oil pump and flowed to a high pressure pump assembly driven by the diesel engine. The pump assembly flows engine oil at high pressure into an oil manifold or compression chamber. The manifold or chamber is connected to the HEUI injectors. Except for large engines, the high pressure pump assembly typically includes a swash plate pump using axial pistons and having an output dependent upon the speed of the diesel engine. Large engines sometimes use a variable angle swash plate pump where the output can be varied independently of engine speed.

The pump assembly pumps oil at a rate depending on engine speed. The output must be sufficient to meet maximum flow requirements. The pressure of the oil in the oil manifold or chamber is controlled by an injection pressure regulator (IPR) valve in response to signals received from the electronic control module for the engine. The IPR valve limits the pressure in the pumped oil by flowing excess high pressure oil back into the engine sump.

A HEUI injection system uses an oil pump assembly to pump oil at a rate dependent upon the rotational speed of the diesel engine and independent of the actual instantaneous flow requirements for the engine and the temperature and viscosity of the engine oil. The pump operates at full capacity at all times, even when excess high pressure oil must be flowed or relieved back to the sump immediately to limit the pressure of the oil in the manifold as required by the engine electronic control module. Considerable power is required to drive the pump assembly at full capacity all the time. The energy required to pump high pressure oil which is relieved back to the sump is wasted and decreases the fuel efficiency of the diesel engine. Energy is converted to heat when high pressure oil is exhausted without doing useful work. The heat in the returned oil must be dissipated, typically by a heat exchanger. Heat exchanger capacity must be increased to accommodate the additional heat load.

There is a need for an improved high pressure pump assembly and method for use in a HEUI diesel engine to improve efficiency of the engine. When the engine oil is hot, the pump assembly should throttle low pressure oil supplied to the high pressure pump to maintain a desired instantaneous pressure in the manifold without over pumping and waste of energy. When the oil is cold, the engine oil pump should supply sufficient unthrottled oil to the high pressure pump for pumping to exceed the desired instantaneous pressure in the manifold. The energy required to pump excess high pressure oil should be used to speed warm up of the engine.

SUMMARY OF THE INVENTION

The invention is an improved HEUI pump assembly and method for a diesel engine. The pump assembly includes an inlet throttle valve for throttling the flow of oil supplied to a high pressure pump when the engine is warmed to a normal operating temperature. When the engine is cold the pump assembly flows unthrottled oil to the high pressure pump in a volume sufficient to meet or exceed pressure requirements. In a first embodiment this is done by an inlet throttle valve deactivator maintaining the inlet throttle valve fully open when the engine is cold. With the inlet throttle valve held open, unthrottled cold oil is supplied through the valve to the high pressure pump, the pump maintains the desired instantaneous pressure in the manifold and the engine is drivable. In a second embodiment, when the engine is cold a normally closed passage extending from the output of the engine oil pump to the inlet of the high pressure pump is opened to bypass the inlet throttle valve and supply unthrottled cold oil directly to the high pressure pump. The high pressure pump provides a high pressure output sufficient to maintain the desired instantaneous pressure in the manifold and make the engine drivable. In both embodiments, the volume of pumped cold oil may exceed the volume of oil required to maintain the desired instantaneous pressure in the manifold and fire the injectors. Excess pumped cold oil is relieved back to the sump. The pressure energy released from the relieved oil is converted to heat energy to speed warming of the oil and engine.

Once the engine oil reaches a desired temperature the pump assembly automatically activates the inlet throttle valve for normal operation. In the first embodiment, the inlet throttle valve is freed for valving movement. In the second embodiment, the bypass passage is closed. In both embodiments, the inlet throttle valve throttles the oil flowed to the high pressure pump to meet the instantaneous pressure requirements of the engine without substantial over pumping. Throttling of oil supplied to the pump increases the efficiency of the engine by reducing the power required to operate the pump when the required instantaneous flow is lower than pump capacity.

The temperature for the engine oil when the inlet throttle valve is activated may be higher than the lowest oil temperature at which the inlet throttle valve works properly. A higher activation temperature may be selected to reduce the time to warm up the engine to a temperature sufficiently high to reduce combustion emissions.

Other objects and features of the invention will become apparent as the description proceeds, especially when taken in conjunction with the accompanying drawings illustrating the invention.

DESCRIPTION OF THE PREFERRED EMBODIMENT

Figure 1:
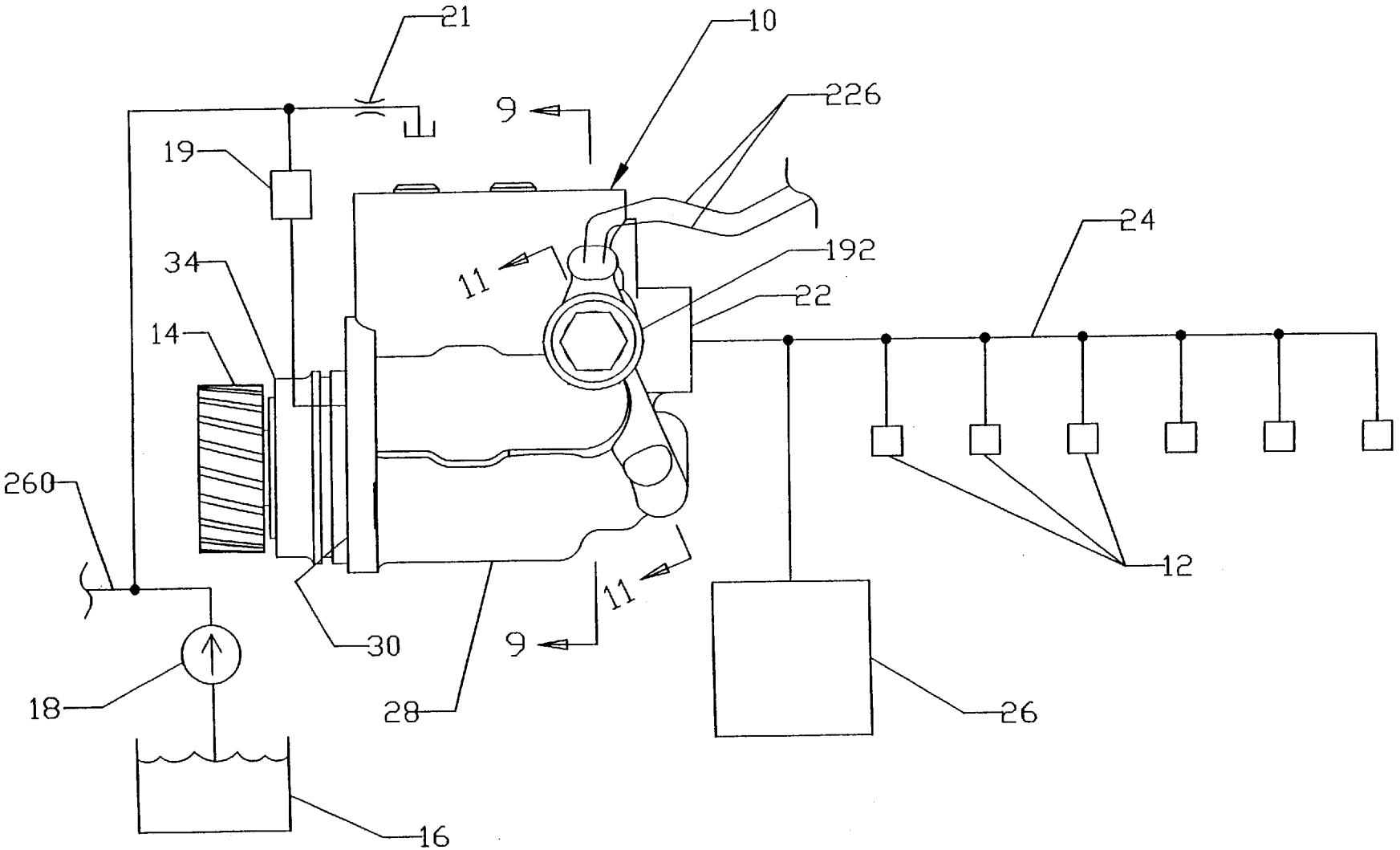
FIG. 1 is a representational view illustrating a first embodiment pump assembly, pressure chamber and injectors.
Figure 2:
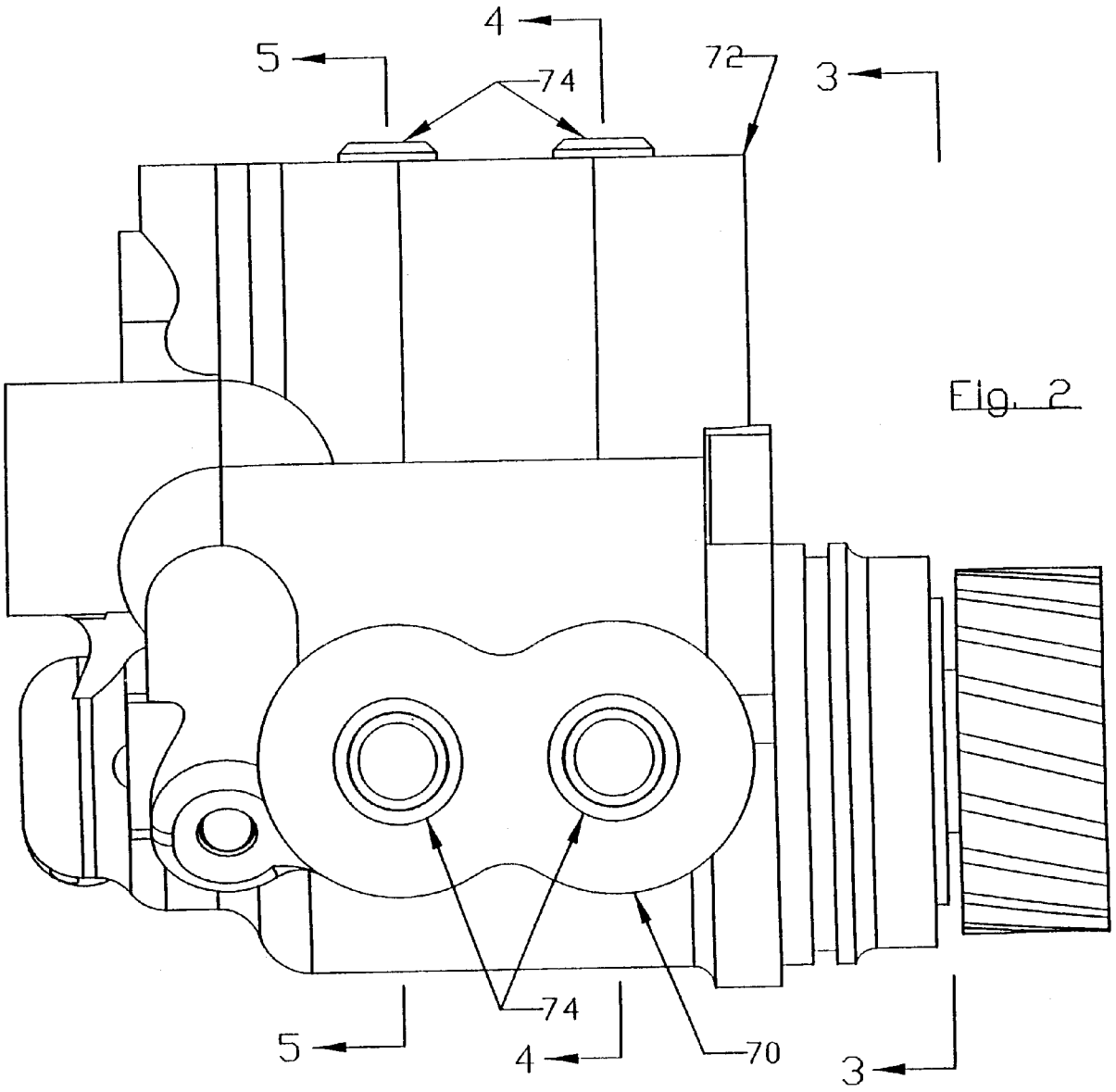
FIG. 2 is a side view of the pump assembly.

The disclosure of Breeden U.S. patent application titled "Pump Assembly and Method," filed May 30, 2000, Ser. No. 09/580,877 is incorporated herein in its entirety.

FIGS. 1–15 illustrate the first embodiment of the invention.

Inlet throttle controlled pump assembly 10 is mounted on a diesel engine, typically a diesel engine used to power an over-the-road vehicle, and supplies high pressure engine oil to solenoid actuated fuel injectors 12. Input gear 14 on pump assembly 10 is rotated by the engine to power the pump assembly. Engine lubricating oil is drawn from sump 16 by engine lubrication oil pump 18 and flowed to start reservoir 19 and pump assembly inlet port 20. The oil pump also flows engine oil through line 260 to engine bearings and cooling jets. Reservoir 19 is located above assembly 10.

The pump assembly 10 displaces the oil and flows the oil from outlet port 22 along flow passage 24 to injectors 12. Flow passage 24 may include a manifold attached to the diesel engine. High pressure compression chamber 26 is joined to flow passage 24. The chamber may be external to the diesel engine. Alternatively, the oil manifold may have sufficient volume to eliminate the need for an external chamber.

Pump assembly 10 includes a cast iron body 28 having a mounting face 30 with mounting holes 32 extending through face 30 to facilitate bolting pump of assembly 10 to the diesel engine. Mounting collar 34 extends outwardly from face 30 and into a cylindrical opening formed in a mounting surface on the diesel engine with gear 14 engaging a gear in the engine rotated by the engine crank shaft. An O-ring seal on collar 34 seals the opening in the engine.

Crank chamber 36 is formed in the lower portion of body 28 and extends between the interior of collar 34 and opposed closed end 38. Crank shaft 40 is fitted in chamber 36. A journal at the inner end of the crank shaft is supported by sleeve bearing 42 mounted in body 28 adjacent the blind end of the crank chamber. A journal at the opposite end of the crank shaft is supported by sleeve bearing 44 carried by bearing block 46. Block 46 is pressed into collar 34. Shaft seal 48 is carried on the outer end of block 46 and includes a lip engaging a cylindrical surface on the outer end of the crank shaft. The lip extends away from crank chamber 36 to permit flow of engine oil from annular space 49 behind the seal, past the seal and back into the diesel engine.

During operation of pump assembly 10 engine oil is flowed into crank chamber 36 and is in contact with the inner bearing surfaces between the crank journals and sleeve bearings 42 and 44. When the pressure in the crank chamber is greater than the pressure at the remote ends of the bearing surfaces between the journals and the sleeve bearings a small lubricating flow of oil seeps through the bearing surfaces and into end chamber 66 and annular space 49. This flow of oil from the crank chamber lubricates the sleeve bearings. The oil collected in chamber 66 from bearing 42 flows through passage 64 to space 49 where it joins oil from the bearing 44. The oil in space 49 lifts lip seal 48 and flows out of the pump assembly and back to the sump of the diesel engine. The two sleeve bearings 44 and 46 form effective pressure seals for the crank chamber 36 and permit the lip of shaft seal 48 to face outwardly on the crank shaft so that it may be lifted to permit oil to flow outwardly from space 49. The position of shaft seal 48 is opposite the position of a conventional shaft seal which would normally have an inwardly facing lip to prevent outward flow.

During inlet throttling the flow of oil into the crank chamber is reduced and the pressure in the crank chamber may be lowered below the pressure inside the diesel engine. This is because the pumps draw a vacuum in the crank chamber. In this case, oil may seep into the crank chamber from space 49 and chamber 66. Inward or outward seep flow of oil through the bearings lubricates the bearings but does not influence operation of the pump.

Threadable fastener 50 secures gear 14 on the end of the crank shaft extending outwardly from the bearing block.

Crank shaft 40 carries two axially spaced cylindrical eccentrics 52, 54 which are separated and joined by a larger diameter disc 56 located on the axis of the crank. The disc strengthens the crank shaft. Each eccentric 52, 54 is provided with an undercut slot 58 located between adjacent sides of the eccentric and extending about 130° around the circumference of the eccentric. Passage 60 extends from the bottom of slot 58 to two cross access passages 62 extending parallel to the axis of the crank shaft and through the eccentric and disc 56. The cylindrical eccentrics 52 and 54 are oriented 1800° out of phase on the crank shaft so that passages 62 for eccentric 52 are located diametrically across the crank shaft axis from passages 62 for eccentric 54. See FIG. 4.

Axial passage 64 extends along the length of the crank shaft. At the inner end of the crank shaft passage 64 opens into end chamber 66 formed in closed end 38 of the crank chamber. A cross passage 68 communicates the outer end of passage 64 with annular space 49 behind seal 48.

Figure 3:
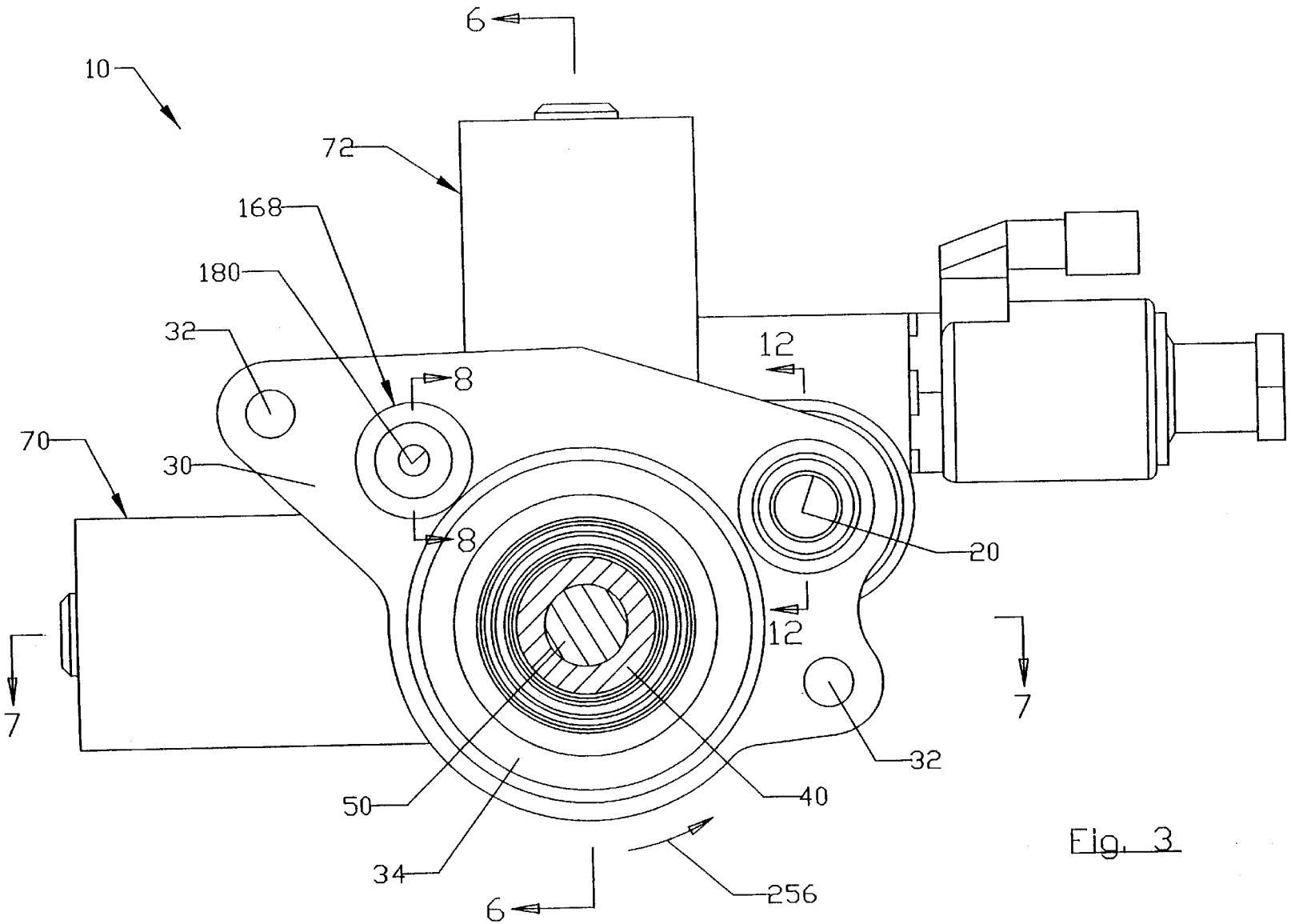
FIGS. 3, 4 and 5 are views taken along lines 3—3, 4—4 and 5—5 of FIG. 2 respectively.

Pump assembly 10 includes four high pressure check valve piston pumps 74 arranged in two 900° oriented banks 70 and 72. Each bank includes two pumps 74. As shown in FIG. 3, bank 70 extends to the left of the crank shaft and bank 72 extends above the crank shaft so that the pump assembly has a Vee-4 construction. One pump 74 in each bank is in alignment with and driven by eccentric 52 and the other pump in each bank is in alignment with and driven by eccentric 54. The four check valve pumps are identical.

Each check valve piston pump 74 includes a piston bore 76 formed in one of the banks and extending perpendicularly to the axis of the crank shaft. A hollow cylindrical piston 78 has a sliding fit within the inner end of bore 76. The piston has a spherical inner end 80 adjacent the crank shaft. End 80 is fitted in a spherical recess in a slipper socket 82 located between the piston and the eccentric actuating the pump. The inner concave surface of the slipper socket is cylindrical and conforms to the surface of the adjacent cylindrical eccentric. Central passage 84 in the spherical end of the piston and passage 86 in the slipper communicate the surface of the eccentric with variable volume pumping chamber 88 in piston 78 and bore 76. The variable volume portion of the pumping chamber is located in bore 76.

A check valve assembly 90 is located in the outer end of each piston bore 76. Each assembly 90 includes a sleeve 92 tightly fitted in the end of bore 76. A cylindrical seat 94 is fitted in the lower end of the sleeve. Plug 96 is fitted in the sleeve to close the outer end of bore 76. Poppet disc or valve member 98 is normally held against the outer end of seat 94 by poppet spring 100 fitted in plug 96. A central boss 99 projects above valve member 98 and is fitted in spring 100.

A piston spring 102 is fitted in each piston 78 and extends between the spherical inner end of the piston 78 and a seat 94. Rotation of crank shaft 40 moves the slots 58 in the surfaces of the eccentrics into and out of engagement with slipper passages 86 to permit unobstructed flow of engine oil from the crank chamber into the pumping chambers 88. Rotation of the crank shaft also moves the pistons 78 up and down in bores 76 to pump oil past the check valves. During rotation of the crank shaft the piston springs 102 hold the pistons against the slippers and the slippers against the eccentrics while the slippers oscillate on the spherical end of the pistons.

Figure 4:
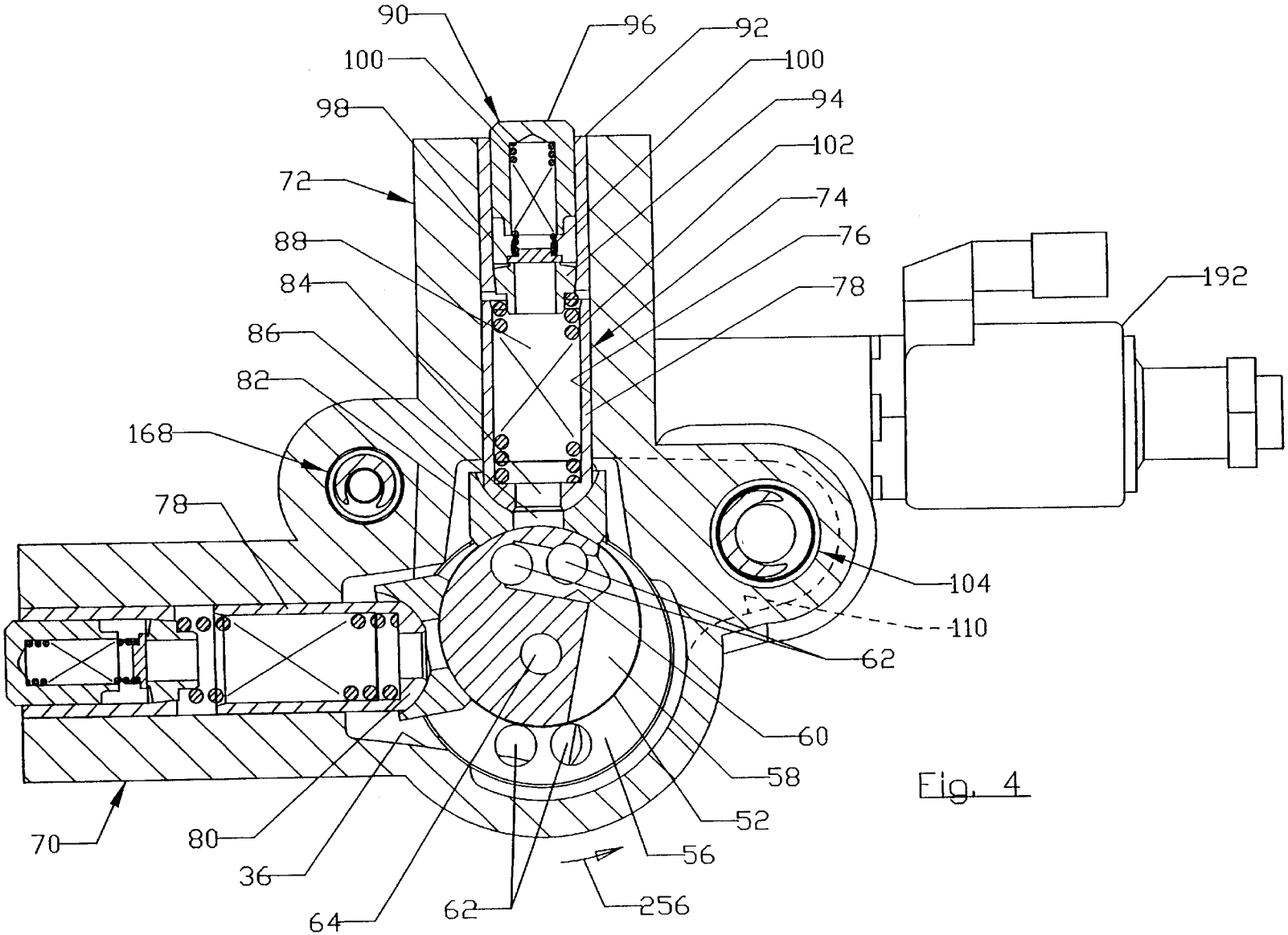
Figure 5:
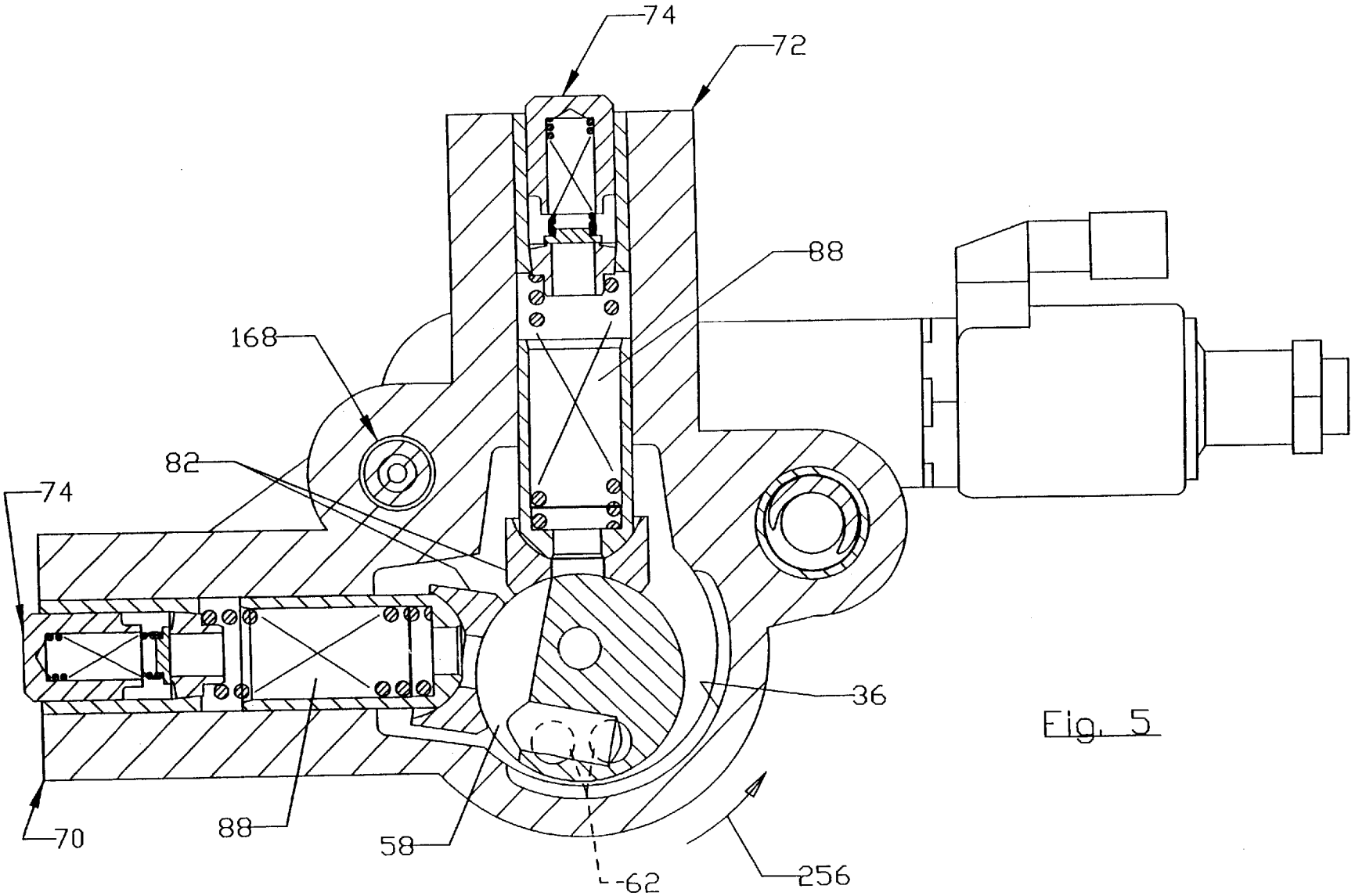
Figure 6:
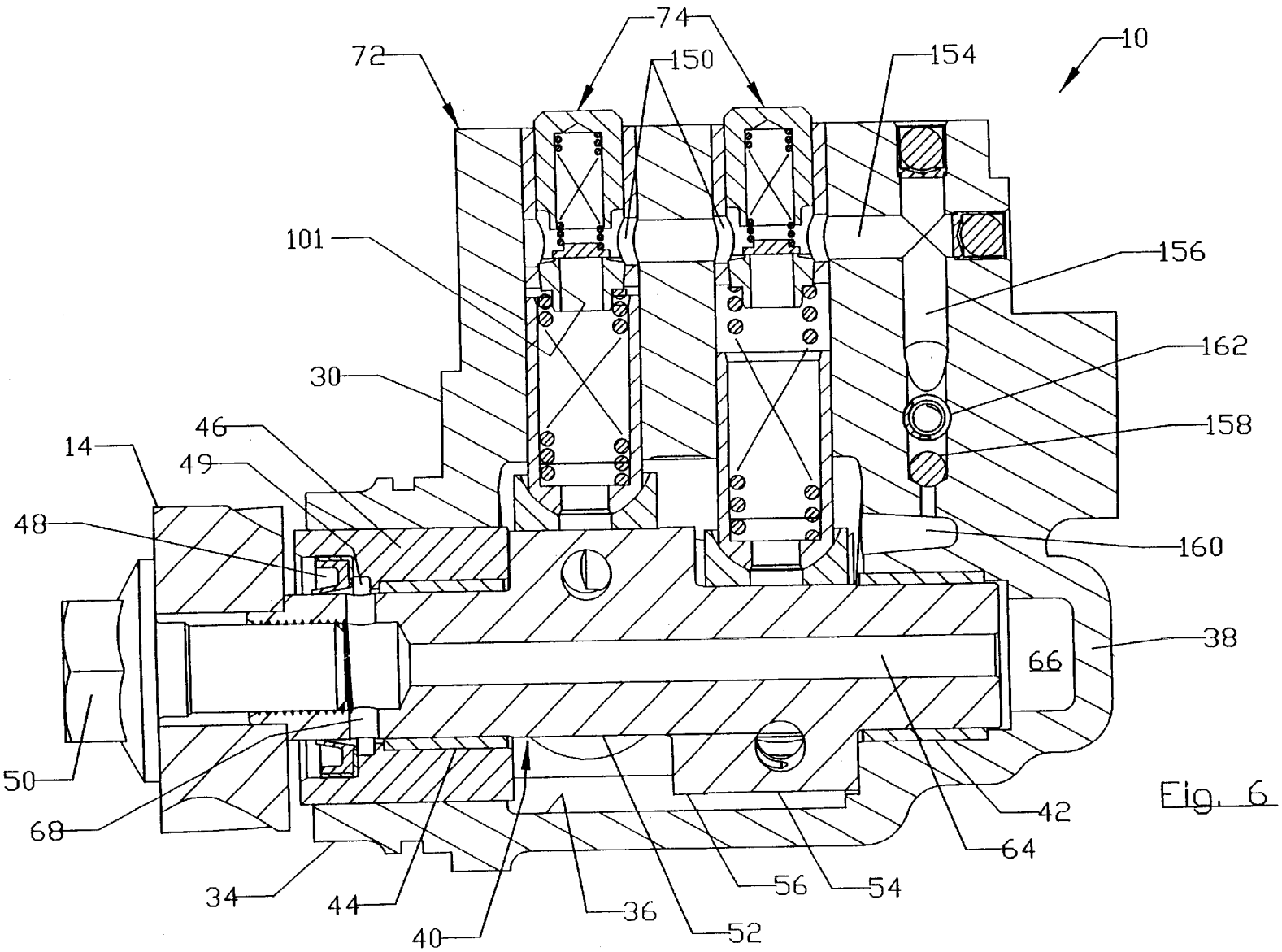
FIGS. 6, 7 and 8 are sectional views taken along lines 6—6, 7—7 and 8—8 of FIG. 3 respectively.

The diesel engine rotates crank shaft 40 in the direction of arrow 256 shown in FIGS. 3, 4 and 5. FIG. 4 shows the position of piston 78 in bank 72 when fully extended into bore 76 at the end of a pumping stroke. Upon further rotation of the crank spring 102 and internal pressure move piston 74 away from the fully extended position. The energy of the trapped, pressurized oil is thereby recovered, and the pressure of the trapped oil drops. Continued rotation of the crank moves slot 58 into communication with passage 86 in the slipper socket 82 to permit flow of oil into the opened pumping chamber 86 during the return stroke of the piston. FIG. 5 illustrates the return stroke with uninterrupted communication between slot 58 and the pumping chamber of pump 74 in bank 70.

Inlet port 20 opens into inlet throttle valve 104 located in body 28. See FIG. 12. When the diesel engine has reached a desired operating temperature valve 104 operates to control the volume of engine oil pumped by the four pumps 74. The valve throttles the flow of oil flowed from oil pump 18, through passage 110, to the crank chamber 36 and into the check valve pumps 74.

The inlet throttle valve 104 includes a bore 106 extending into the body from mounting face 30 to closed end 108. Oil inlet passage 110 surrounds the center of bore 106 and communicates the bore with crank chamber 36. See FIG. 4. Hollow cylindrical spool or valving member 112 has a close sliding fit in the bore permitting movement of the spool along the bore. Outer end 114 of the spool is open and inner end 116 is closed. Retainer 118 is fitted in the outer end of bore 106. Inlet throttle spring 120 is confined between the ring 118 and the inner end 116 of the spool to bias the spool toward the closed end 108 of the bore. Locating post 122 extends inwardly from the closed end of the spool to the end of the bore. Chamber 125 surrounds post 122 at the closed end of the bore. Passage 124 communicates injector pressure regulator valve 192, described below, with chamber 125 at the inner end of bore 106. Post 122 prevents spool 112 from closing passage 124. Closed spool end 116 prevents flow between chamber 125 and the interior of the spool. The spool at all times extends past passage 110.

Figure 13:
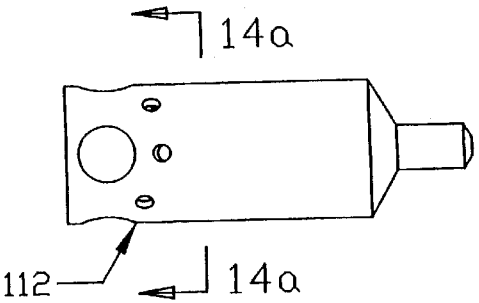
FIG. 13 is a side view of the inlet throttle valve spool.
Figure 14A:
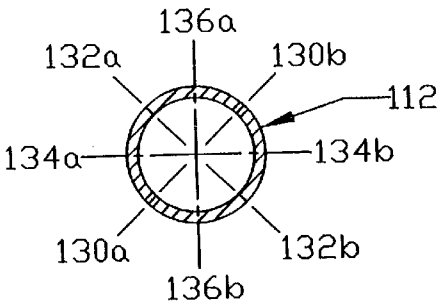
FIG. 14*a* is a sectional view taken along line 14*a*–14*g* of FIG. 13 showing the circumferential locations of flow openings.
Figure 14:
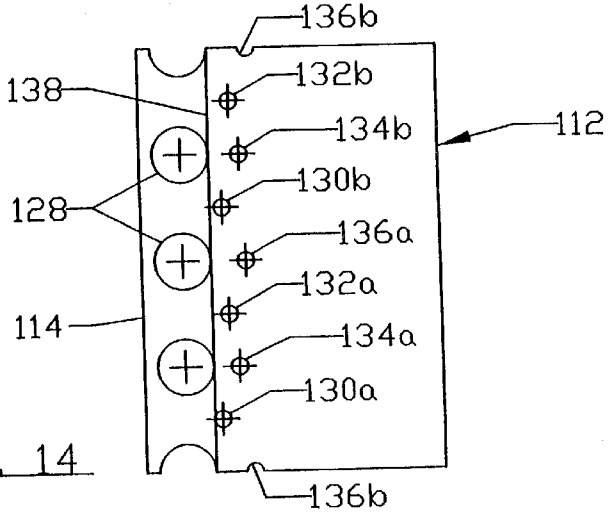
FIG. 14 is a view of the surface of the inlet throttle valve spool unwound.

As shown in FIGS. 13 and 14, four large diameter flow openings 128 extend through the wall of the spool adjacent open end 114. Four pairs of diametrically opposed and axially offset flow control openings 130–136 are formed through the wall of the spool at short distances inwardly from flow openings 128. Small diameter flow control opening **130*a* is diametrically opposed to small diameter flow opening 130*b*. As indicated by line 138, the outer edge of opening of 130*a* lies on line 138 at the inner edge of openings 128. Opening 130*b* is shifted a short distance inwardly from opening 130*a*. The shift difference may be slightly more than ¼ the diameter of the openings. A second set of small diametrically opposed openings 132*a* and 132*b* are formed through the spool. Opening 132*a* is shifted the same distance inwardly from opening 130*b* and opening 132*b* is located inwardly slightly more than ¼ the diameter of opening 132*a*. A third set of small diametrically opposed openings 134*a* and 134*b* are formed through the spool with opening 134*a* located inwardly from opening 132*b* slightly more than ¼ the diameter of the opening and opposed small diameter opening 134*b* located inwardly from opening 134*a* slightly more than ¼ the diameter of the opening. Likewise, small diameter flow passage 136*a* is located inwardly from opening 134*b* slightly more than ¼ the diameter of the opening and diametrically opposed small diameter flow opening 136*b* is located inwardly from small diameter opening 136*a*** by slightly more than ¼ the diameter of the opening.

During opening and closing movement of the spool 112 in bore 106 the flow openings 128–136 move past inlet passage 110. During initial closing movement of the spool from the fully open position shown in FIG. 12 large flow openings 128 are rapidly closed. Further closing movement moves the small diameter flow openings **130*a*, 130*b*, 132*a* and 132*b* past and openings 134*a*, 134*b*, 136*a* and 136*b* partially past the oil inlet passage 110 to reduce the area of the opening flowing oil into the crank chamber. Travel of spool 104 is stopped when it contacts retainer 118**, allowing minimum flow through the pump for cooling and lubrication. The overlapping positions of the small diameter flow passages assures that the flow opening is reduced smoothly.

The opposed pairs of passages **130*a*, 130*b*; 132*a*, 132*b*; 134*a*, 134*b*; and 136*a*, 136*b*; reduce frictional loading or hysteresis on the spool during shifting as the spool is moved back and forth in bore 106. The opening in each pair of openings are diametrically opposed and are either open or closed except when the openings are crossing the edge of oil inlet passage 110. The diametral opposition of the slightly axially offset pairs of openings effectively balances radial pressure forces and reduces binding or hysteresis during movement of the spool. Reduction of binding or hysteresis assures that the spool moves freely and rapidly along the bore in response to a pressure differential across inner end 116**.

Binding or hysteresis is further reduced by locating axially adjacent pairs of diametrically opposed flow openings circumferentially apart as far as possible. For instance, as shown in FIG. **14*a*, openings 132*a* and 132*b* are located at 90 degrees to openings 130*a* and 130*b* and openings 136*a* and 136*b* are located 90 degrees to openings 134*a* and 134*b*. Openings 132*a* and 132*b* are, of necessity, located at 45 degrees to openings 134*a* and 134*b***. Further, all of the "a" openings are located on one side of the spool and all of the "b" openings are located on the opposite side of the spool valve. This arrangement reduces binding and hysteresis by assuring that the side loadings exerted on the spool as the small diameter flow passages are opened or closed are balanced and offset each other.

In one valve 104, bore 106 has a diameter of 0.75 inches with the spool having an axial length from outer end 114 to inner 116 of about 1.65 inches. The large diameter flow openings 126 have a diameter of 0.312 inches and the small diameter flow openings **132*a*–*136b*** each have a diameter of 0.094 inches. The small diameter flow openings are axially offset, as described, with adjacent openings offset approximately 0.025 inches, slightly more than ¼ the diameter of the openings.

Figure 9A:
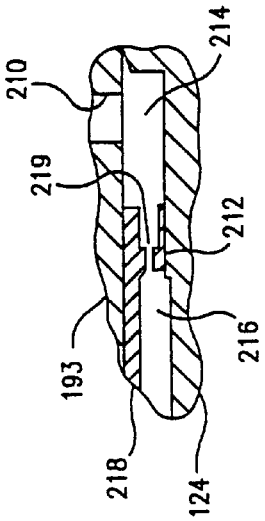
FIG. 9*a* is an enlarges view of a portion of FIG. 9.
Figure 9:
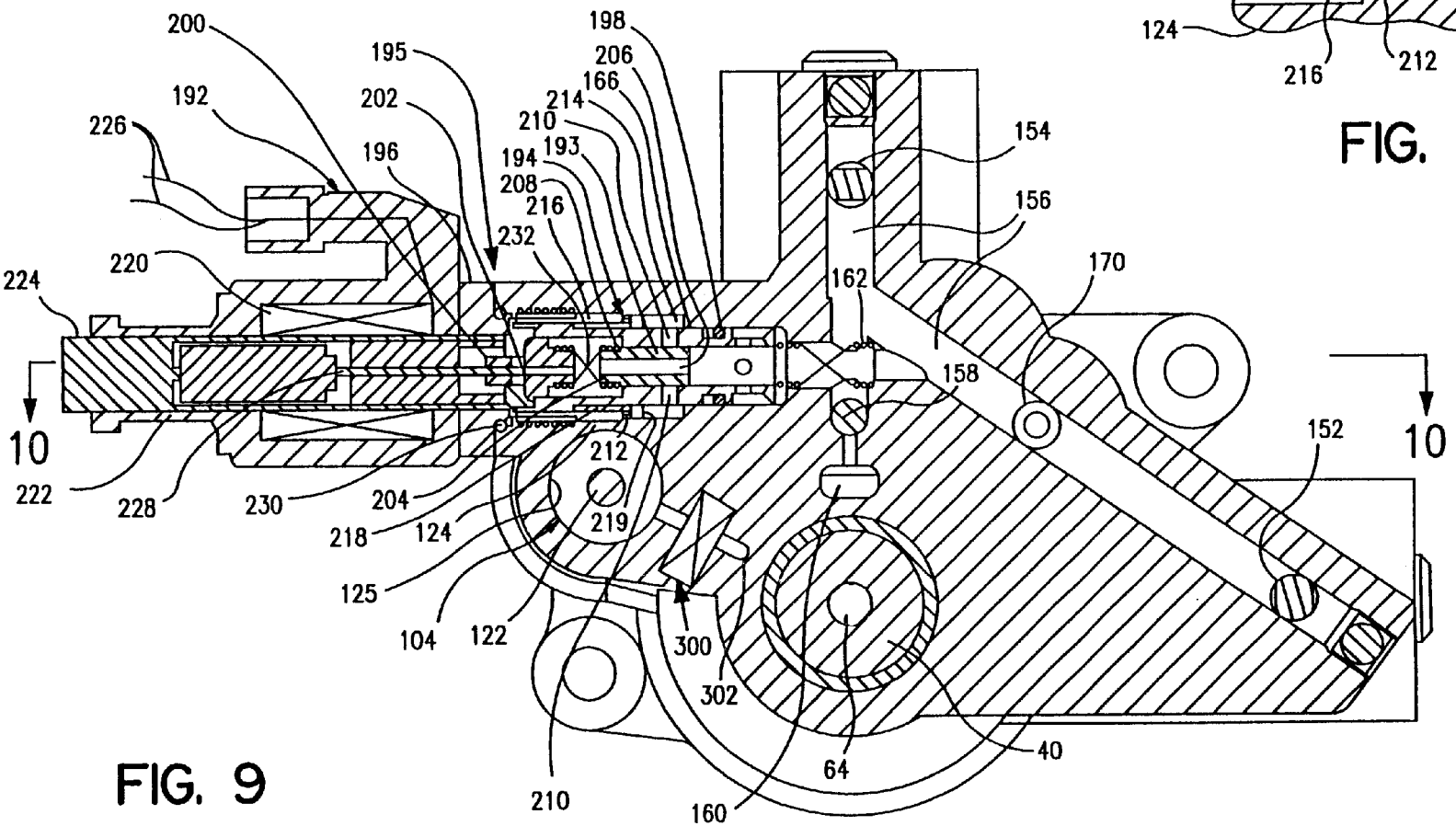
FIG. 9 is a sectional view taken along line 9—9 of FIG. 1.

Oil flowed into the crank chamber is pumped by the check valve pumps 74 into outlet openings 150 extending through sleeves 92. Openings 150 in the pumps 74 in bank 70 communicate the spaces in the pumps above the poppet discs with high pressure outlet passage 152. The outlet opening 150 in the pumps 74 in bank 72 communicates the spaces above the poppet discs with high pressure outlet passage 154. Angled high pressure outlet passage 156 joins passages 152 and 154, as shown in FIG. 9.

A makeup ball check valve 158 is located between passage 156 and passage 160 opening into crank chamber 36. See FIG. 6. Gravity and the pressure of oil in the outlet passages normally hold valve 158 closed. Spring 162 is fitted in a cross passage above the check valve to prevent dislodgement of the ball of valve 158. When the diesel engine is shut off and cools, pressure drops and oil in the high pressure flow passages and manifold 24 cools and contracts. Engine crank case pressure acting on the fluid in reservoir 19 lifts the ball of valve 158 and supplies makeup oil from the crank chamber to the high pressure flow passages to prevent formation of voids in the passages.

Figures 7, 8:
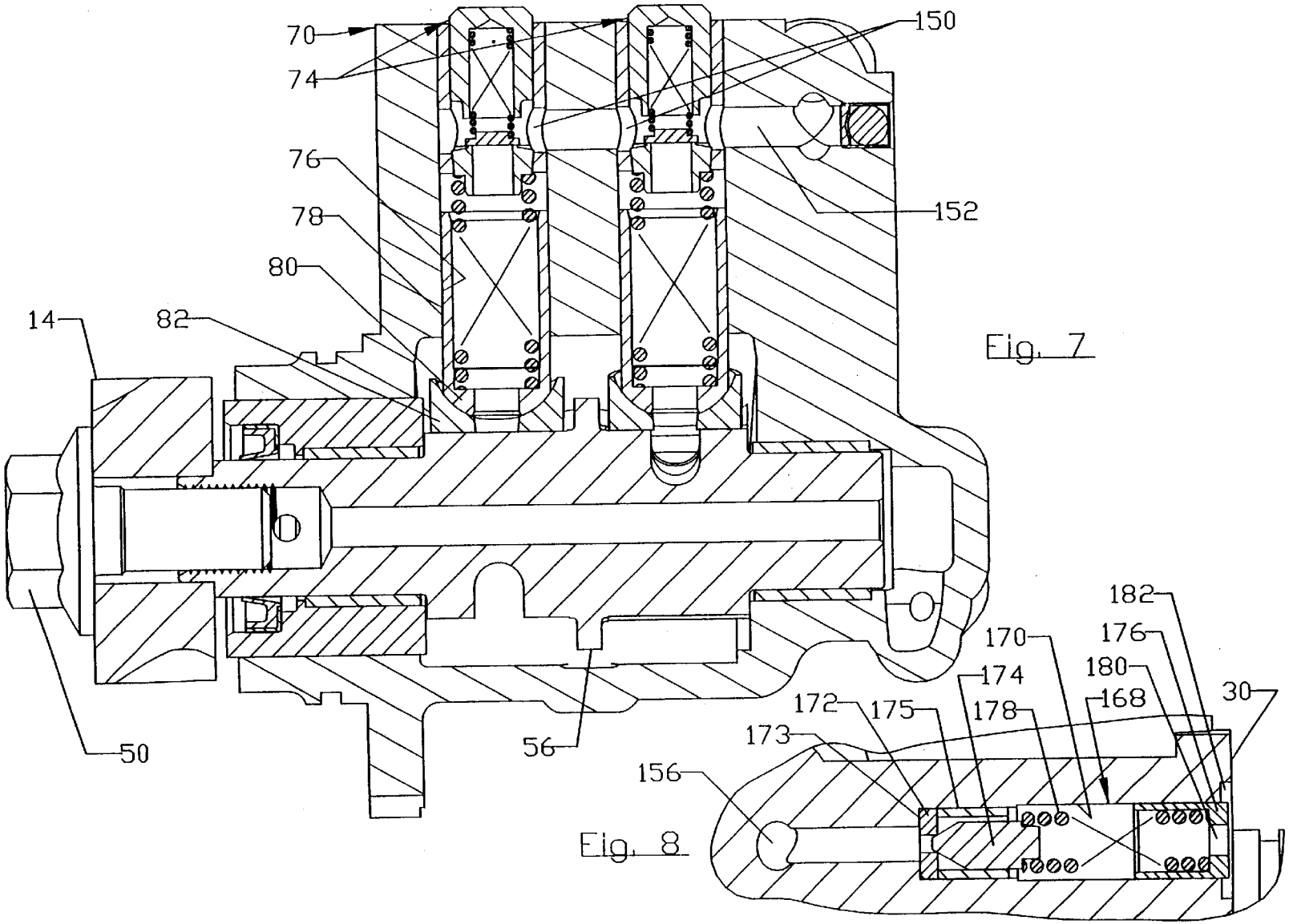

High pressure mechanical relief valve 168 shown in FIG. 8 is located between banks 70 and 72 and extends parallel to the axis of the crank shaft. The valve 168 includes a passage 170 extending from mounting face 30 to high pressure outlet passage 156. Valve seat 172 is held against step 173 in passage 170 by press fit sleeve 175. The step faces away from passage 156. Valve member 174 normally engages the seat to close the valve. Retainer sleeve 176 is press fitted into passage 170 at face 30. Spring 178 is confined between the retainer and the valve member 174 to hold the valve member against the seat under high pressure so that valve 168 is normally closed. When pump assembly 10 is mounted on a diesel engine the outlet opening 180 in sleeve 176 is aligned with a passage leading to the engine oil sump. An O-ring seal is fitted in groove 182 to prevent leakage. Opening of the mechanical relief valve 168 flows high pressure oil from the outlet passage 156 back into the engine sump. Valve 168 has a high cracking pressure of about 4,500 pounds per square inch.

The cross sectional area between sleeve 175 and valve member 174 is selected so that when the valve is open the force from pressurized oil acts on the cross sectional area of valve member 174. Increased flow through the relief valve requires increased displacement of valve member 174 from seat 172, thereby requiring greater force as spring 178 is deflected against its spring gradient. The flow restriction between valve member 174 and sleeve 175 is chosen so that the supplemental force from increasing flow will offset the increased spring force, and relief pressure will be relatively independent of flow rate through the relief valve.

High pressure outlet passage 156 opens into stepped bore 166 extending into body 28 above the inlet throttle valve 104 and transversely to the axis of crank shaft 40. See FIG. 9. Drain passage 190 extends from the outer large diameter portion of stepped bore 166 to chamber 66. See FIG. 11.

Injection pressure regulator (IPR) valve 192 is threadably mounted in the outer portion of stepped bore 166. The valve 192 is an electrically modulated, two stage, relief valve and may be Navistar International Transportation Corporation of Melrose Park, Ill. Part No. 18255249C91, manufactured by FASCO of Shelby, N.C.

IPR valve 192, shown in FIG. 9, has an elongated hollow cylindrical body 193 threadably mounted in the large diameter portion of stepped bore 166 and a base 196 on the outer end of body 193. The IPR valve includes a main stage mechanical relief valve 194 located on the inner end of body 193 and a pilot stage electrically modulated relief valve 195 located in the outer end of body 193. Body 193 retains spring 162 in place. An o-ring and a backup ring 198 seal the inner end of body 193 against the reduced diameter portion of the bore. A cylindrical valve seat 200 is mounted inside body 193 adjacent base 196 and includes an axial flow passage 202.

Main stage valve 194 includes a cylindrical spool 204 slideably mounted in body 193 and having an axial passage including restriction 206. Spring 208, confined between valve seat 200 and spool 204, biases the spool toward the inner end of bore 166 to the position shown in FIG. 9. The spring holds the spool against a stop in body 193 (not illustrated). Oil from high pressure outlet passage 156 flows into the inner end of body 193.

Collar 212 is fixedly mounted on body 193 and separates the large diameter portion of bore 166 into inner cylindrical chamber 214 extending from the step to the collar and outer cylindrical chamber 216 extending from the collar to base 196. A narrow neck 218 on the collar spaces the collar from the base. Small diameter bleed passage 219 extends through collar 212 to communicate chambers 214 and 216. See FIG. 9A.

If a transient over pressure occurs in the high pressure passages, the pressure of the oil shifts the spool 204 of the main stage valve 194 to the left or toward seat 200 against spring 208. Movement of the spool is sufficient to move the end of the spool away from the spring and past a number of discharge passages 210 extending through body 193. High pressure oil then flows through passages 210, into the chamber 214, through drain passage 190 to chamber 66 and then back to the sump of the diesel engine, as previously described.

The pilot stage valve 195 includes a solenoid 220 on base 196. The solenoid surrounds an armature 222 axially aligned with base 196. The lefthand end of the armature engages retention block 224 retained by a tube affixed to body 196. Solenoid leads 226 are connected to the electronic control module for the diesel engine. A valve pin 228 contacting armature 222 extends toward the flow passage 202 in valve seat 200 and has a tapered lead end which engages the seat to close the passage when the armature is biased towards the seat by solenoid 220.

High pressure oil from passage 156 flows into body 196, through restriction 206, and through passage 202 in seat 200 to the end closed by valve pin 228. The electronic control module sends a current signal to the solenoid to vary the force of the pin against the valve seat and control bleed flow of oil through the passage 202 and internal passages in the IPR valve, including slot 230 in the threads mounting the IPR valve on body 28 and leading to chamber 216. The oil from chamber 216 flows through restriction 219 to chamber 214 and thence to the engine sump as previously described. Chamber 216 is connected to chamber 125 by passage 124 so that the oil in chamber 216 pressurizes the oil in chamber 125 of the inlet throttle valve. IPR valve 192 is shown in detail in FIG. 9 and diagrammatically in FIGS. 10 and 11.

Gear 14 rotates crank shaft 40 in the direction of arrow 256 shown in FIGS. 3, 4 and 5, or in a counterclockwise direction when viewing mounting face 30. Rotation of the crank rotates eccentrics 52 and 54 to reciprocate the pistons 78 in bores 76. In each high pressure pump 74 spring 102 holds the inner spherical end of piston 78 against a slipper 82 to hold the slipper against a rotating eccentric as the piston is reciprocated in bore 76. During return or suction movement of the piston toward the crank shaft the inlet passage leading from crank chamber 36 to the pumping chamber 88 is unobstructed. There are no check valves in the inlet passage. The unobstructed inlet passage extends through passages 62, passage 60, slot 58 and passages 86 and 84 in the slipper and inner end of the piston 78. The unobstructed inlet passage permits available engine oil in the crank chamber to flow freely into the pumping chambers during return strokes. The inlet passage is opened after piston 78 returns sufficiently to allow trapped oil to expand near the beginning of the return stroke and is closed at the end of the return stroke.

FIG. 4 illustrates check valve pump 74 in bank 72 at top dead center. Oil in chamber 88 has been flowed past poppet valve 98 and the valve has closed. The closed pumping chamber 88 remains filled with oil under high pressure. Passage 86 in slipper 82 is closed and remains closed until the crank rotates an additional 18 degrees beyond top dead center and slot 58 communicates with passage 86. During the 18 degree rotation from top dead center piston 78 travels from top dead center down two percent of the return stroke and the pumping chamber and compressed fluid in the chamber expand to recover a large portion of the energy of compression in the fluid. The recovered energy assists in rotating the crank shaft. Recovery of the compressed energy of the fluid in the pumping chamber reduces the pressure of the fluid in the chamber when the pumping chamber opens to the crank chamber so that the fluid does not flow outwardly into the slot 58 in the crank shaft at high velocity. Recapture of the energy in the compressed fluid in the pumping chamber improves the overall efficiency of the pump by approximately two percent.

If the slot in the crank were moved over opening 86 at or shortly after top dead center, the high pressure fluid in the pumping chamber would flow through the opening and into the slot at a high velocity. This velocity is sufficient to risk flow damage to the surfaces of passage 84 and 86 and slot 58. Opening of the pumping chamber at approximately 18 degrees after top dead center permits reduction of the pressure in the pumping chamber before opening and eliminates high flow rate damage to the surfaces in the pump. The pumping chamber opens sufficiently early in the return stroke to allow filling before closing at bottom dead center.

It is important that the inlet passage is unobstructed during cold startup. While the passage is open, available engine oil, which may be cold and viscous, in the crank chamber flows into the pumping chambers during return strokes as the volume of the pumping chambers increases. The circumferential length of slots 58 and the diameter of passages 86 are adjusted so that the pumping chambers in the pistons are open to receive oil from the crank chamber during substantially all of the return stroke.

The poppet valve for the pump is held closed during the return stroke by spring 100 and high pressure oil in the outlet passages. In FIG. 5, pump 74 in bank 72 is at the bottom of the return stroke. Oil has flowed into pumping chamber 88 and the inlet passage communicating with the crank chamber is closed at bottom dead center. Pump 74 in bank 70 has moved through part of its return stroke and the inlet passage to the pumping chamber 88 is in unobstructed communication with the crank chamber. Oil may flow from the crank chamber directly into slot 58 to either side of a slipper 82 or may flow into the slot through passages 60 and 62.

The unobstructed inlet passage is open to flow available oil into the pumping chamber during the entire return stroke of the piston, with the exception of the first two percent of the stroke following top dead center. Provision of an unobstructed inlet passage to the pumping chamber during essentially the entire return stroke increases the capacity of the pump and facilitates flowing cold, viscous oil into the pumping chamber during starting.

After each piston completes its return stroke the pumping chamber is filled or partially filled with available oil from chamber 36, depending upon the volume of oil flowed to the crank chamber through inlet throttle valve 104. Continued rotation of the crank shaft then moves the piston outwardly through a pumping stroke. During the pumping stroke slot 58 on the eccentric driving the piston is away from passage 86 in the pump slipper and the inlet passage leading to the pumping chamber is closed at the eccentric. Outward movement of the piston by the eccentric reduces the volume of the pumping chamber and increases the pressure of oil in the chamber. A void in a partially filled chamber is collapsed as volume decreases after which pressure builds. When the pressure of the oil in the chamber exceeds the pressure of the oil in the high pressure side of the poppet disc 98 the disc lifts from seat 94 and the oil in the pumping chamber is expelled through the opening in the seat into the high pressure passages. Pumping continues until the piston reaches top dead center at the end of the pumping stroke and commences the return stroke. At this time, spring 100 closes the poppet valve and the pressure in the pumping chamber decreases below the pressure of the oil in the high pressure passages.

During operation of pump assembly 10 sleeve bearings 42 and 44 are lubricated by bleed flows of oil from crank chamber 36. The oil flowing through bearing 44 collects in the space 49 behind seal 48, lifts the seal, flows past the seal and drains into the sump of the diesel engine. Oil flowing through bearing 42 collects in end chamber 66, together with any oil flowing through passage 190 and into the chamber from the pilot and main stages of the IPR valve. The oil in chamber 66 flows through the axial bore 64 in the crank shaft, through cross passage 68, lifts and passes the seal 48 and then drains into the sump of the diesel engine. The bearings 42 and 44 may be lubricated by oil flowing into chamber 66 under conditions of inlet throttling when pressure on the crank chamber 36 is below atmospheric pressure.

Figure 15:
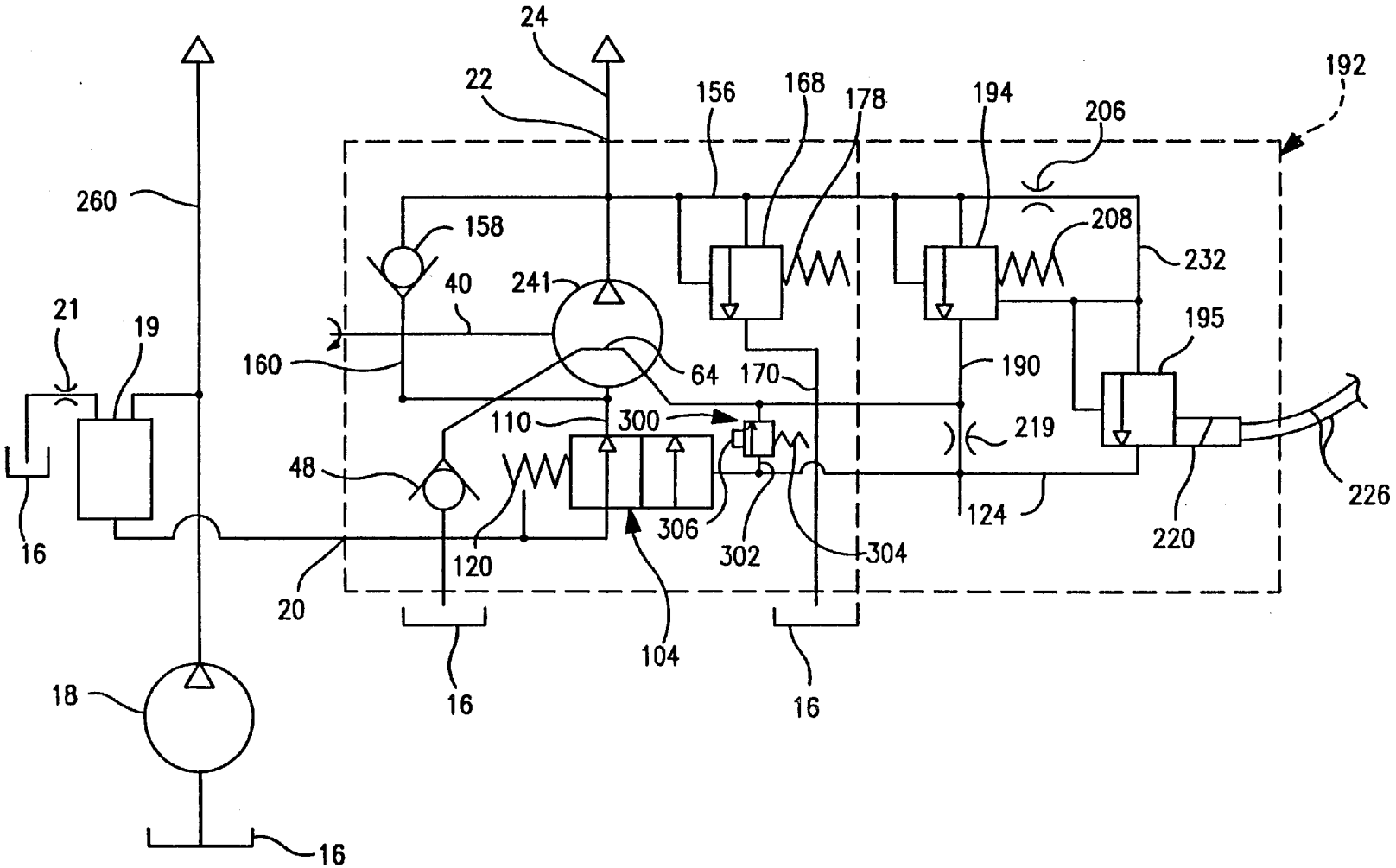
FIG. 15 is a diagram of the hydraulic circuitry of the first embodiment pump assembly.

FIG. 15 illustrates the hydraulic circuitry of pump assembly 10. The components of inlet pressure regulator valve 192 are shown in the dashed rectangle to the right of the figure. The remaining components of pump assembly 10 are shown in the dashed rectangle to the left of the figure.

The diesel engine oil pump 18 flows engine oil from sump 16 to start reservoir 19, inlet port 20 and, through line 260, to bearings and cooling jets in the diesel engine. The start reservoir 19 is located above the pump assembly 10. The reservoir includes a bleed orifice 21 at the top of the reservoir. When the reservoir is empty the bleed orifice vents air from the enclosed reservoir to the engine crank case permitting pump 18 to fill the reservoir with engine oil. During operation of the engine reservoir 19 is filled with engine oil and the bleed orifice spills a slight flow of oil to the sump. When the engine stops, the pressure of the oil in the reservoir 19 falls and the bleed orifice allows air at engine crankcase pressure to permit gravity and suction flow of oil from the reservoir through inlet port 20 and into the crank chamber 36. In this way, oil from reservoir 19 is available for initial pumping to the injectors during cranking and startup of the diesel engine, before the oil pump 18 draws oil from sump 16 and flows the oil to the pump assembly.

Oil flows from port 20 to the inlet throttle valve 104. Oil from the inlet throttle valve 104 flows to the four check valve pumps 74, indicated by pump assembly 241. Rotation of pump crank shaft 40 flows pressurized oil from assembly 241 to high pressure outlet passage 156 and through high pressure outlet port 22 to flow passage 24 and fuel injectors 12.

The high pressure outlet passage 156 is connected to the inlet of pump assembly 241 by makeup ball check valve 158 and passage 160. The high pressure outlet line 156 is connected to high pressure mechanical relief valve 168 which, when opened, returns high pressure oil to sump 16 to limit maximum pressure.

Two stage injection pressure regulator valve 192 includes main stage mechanical pressure relief valve 194 and pilot stage electrically modulated relief valve 195. The mechanical pressure relief valve 194 is shown in a closed position in FIG. 9. In the closed position, spool 204 closes discharge passages 210. Shifting of the spool to the left from the position shown in FIG. 9 opens passages 210 to permit high pressure oil from passage 156 to flow through passages 210, passage 190 and thence back to the diesel engine sump, as previously described.

The pressurized oil in passage 156 biases spool 204 in valve 195 toward the open positioned and is opposed by spring 208 and the pressure of fluid in chamber 232 in the IPR valve. Chamber 232 is connected to high pressure passage 156 through internal flow restriction 206 in the spool.

Figure 12:
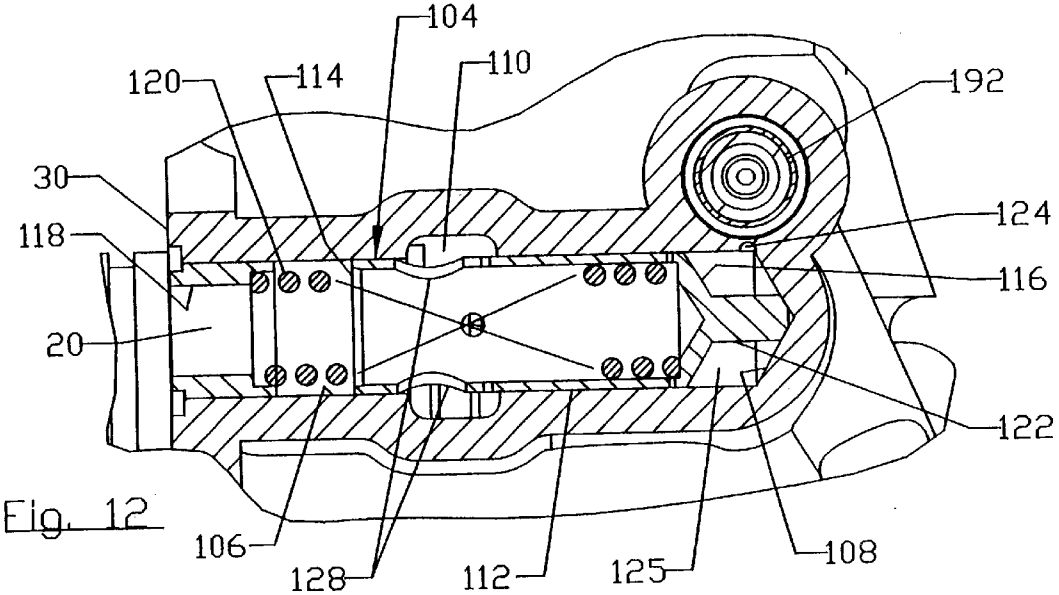
FIG. 12 is a sectional view taken along line 12—12 of FIG. 3.

The pressure of the oil in chamber 232 acts over the area of the hole in seat 200 on one end of the valve pin 228 of pilot stage of valve 195 to bias the pin toward an open position. Solenoid 220 biases the pin toward the closed position against seat 200. A pilot flow of oil from valve 195 flows through slot 230 in the threads mounting base 196 in the outer portion of bore 166, into chamber 216, through orifice 219 into the chamber 214 and then to the engine sump. Pressurized oil in chamber 216 is conducted by passage 124 to chamber 125 of the inlet throttle valve 104 to bias spool 112 to the left as shown in FIG. 12, away from closed end 108 of bore 106. Spring 120 and pressure of the oil from pump 18 bias the spool in the opposite direction. The position of the spool depends on the resultant force balance.

Figures 10, 11:
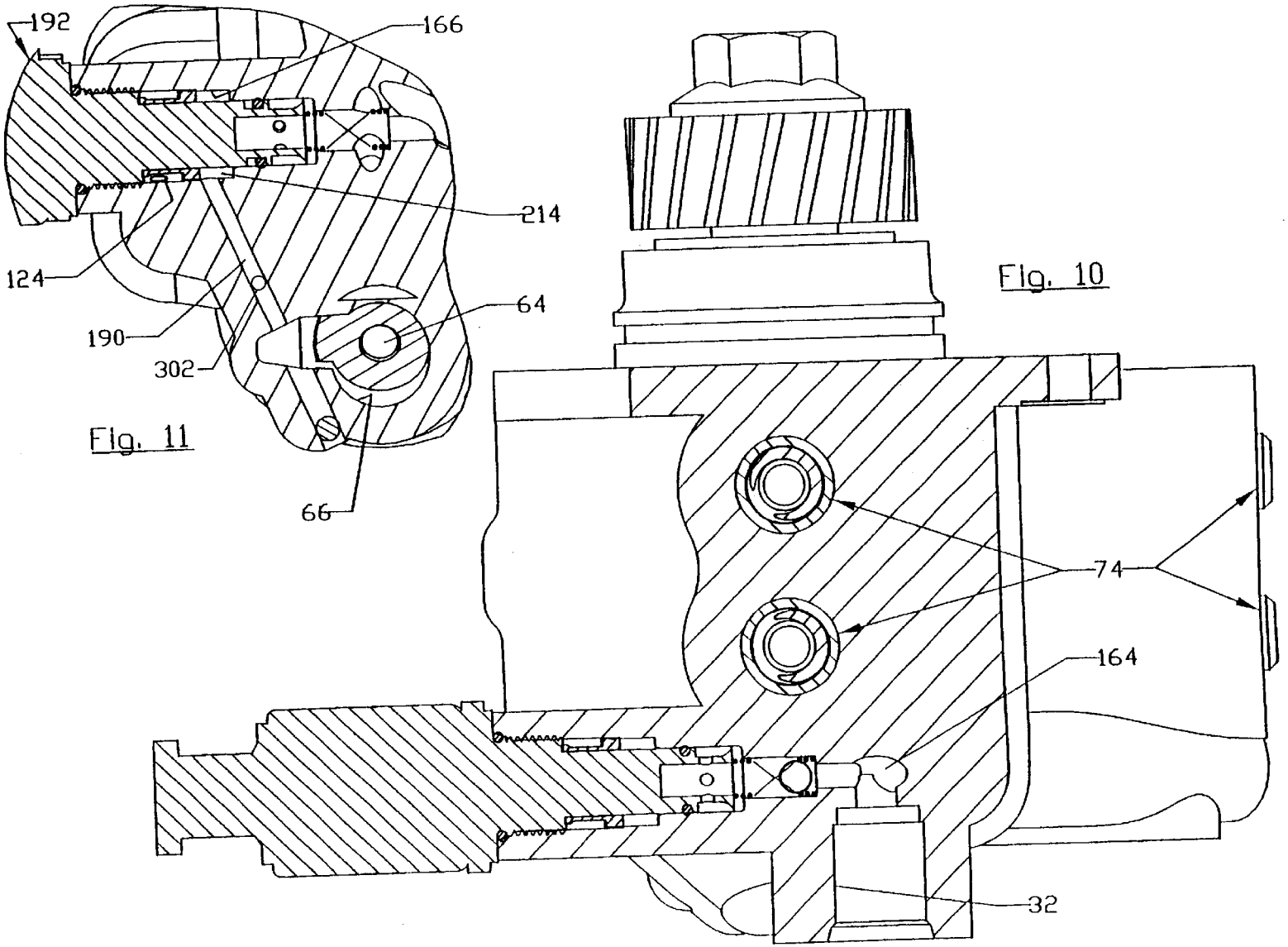
FIG. 10 is a sectional view taken along line 10—10 of FIG. 9.
FIG. 11 is a sectional view taken along line 11—11 of FIG. 1.

Temperature responsive valve 300 is located in passage 302 which communicates inlet throttle valve chamber 125 with drain passage 190. Passage 302 is shown in FIGS. 9 and 11 of the drawings. The valve 300 and passage 302 form a deactivator for the inlet throttle valve and maintain the inlet throttle valve spool 112 in the open position when the engine is cold.

Valve 300 includes a valving member (not illustrated) which is moveable between a retracted position opening passage 302 and extended position closing passage 302. The valve may include a spring 304 which biases the valving member toward the retracted or open position. Valve 300 includes a temperature responsive member 306 connected to the valving member. At low temperatures, member 306 holds the valving member in the open position so that inlet throttle valve chamber 125 is vented to the engine crank case through drain passage 190 and inlet throttle spring 120 holds the inlet throttle valve 104 in the full open position illustrated in FIG. 12. When the temperature of the pump assembly and oil increases, the temperature of responsive member 306 increases and the member shifts the valving member to the closed position. Pressurized oil from valve 195 is then flowed through passage 124 to chamber 125 to bias the inlet throttle spool to the left, as shown in FIG. 12, so that the position of the spool depends upon the resultant force balance.

Temperature responsive member 306 automatically opens valve 300 when the temperature of the member, essentially the temperature of the engine oil, is sufficiently low to prevent stable operation of the inlet throttle valve and make the engine undrivable. For pump assembly 10, this temperature may be about 15 degrees Fahrenheit. If desired, the temperature responsive member 306 in valve 300 may close valve 300 at a temperature higher than the minimum 15° Fahrenheit temperature to assure that the engine is rapidly warmed up to a higher temperature at which the diesel engine operates efficiently with low environmental emissions. In this case, the valve may close between 125 and 150 degrees Fahrenheit.

Temperature responsive member 306 may be a cartridge of wax material having a coefficient of thermal expansion over the desired opening temperature range for valve 300. Wax cartridges of this type are used to activate engine-rotated cooling fans for internal combustion engines. Other types of temperature responsive members are contemplated within the scope of the invention. For instance, valve 300 could include a solenoid actuator for shifting the valving member in response to opening or closing of a switch by a thermal sensor mounted on the diesel engine or the cooling system for the diesel engine. Alternatively, such a solenoid actuator could be operated by a temperature-dependent signal supplied by the electronic control module for the diesel engine.

Operation of first embodiment inlet throttled control pump assembly 10 will now be described.

At startup of the diesel engine start reservoir 19 contains sufficient oil to supply pump 10 until oil is replenished by the diesel engine oil pump. Bleed orifice 21 allows the reservoir to be at engine crank case pressure. The high pressure manifold 24 is full of oil at low pressure. Spring 120 in inlet throttle valve 104 has extended spool 112 to the fully open position shown in FIG. 12.

Actuation of the starter motor for the diesel engine rotates gear 14 and crank shaft 40. Engine oil pump 18 is also rotated but does not flow oil into the pump assembly immediately. During starting, gravity and engine crank case pressure flow engine oil from reservoir 19 into port 20, through the open inlet throttle valve and into crank chamber 36. The oil in the crank chamber is drawn by vacuum freely into pumping chambers 88 through the unobstructed inlet passages in the crank shaft, slippers and inner ends of the piston 78. During starting, the pump assembly flows oil into manifold 24. Pressure increases to a starting pressure to actuate injectors 12. The starting pressure may be 1,000 psi. The reservoir 19 has sufficient volume to supply oil to the pump assembly until the oil pump establishes suction and flows oil to the assembly. During starting and initial pressurization of manifold 24, valves 194 and 195 are closed.

During starting of a warmed diesel engine with valve 300 closed, an electric starter rotates the crank shaft of the engine and auxiliary components including the oil pump 18 and pumps assembly 10 relatively slowly. In order for the engine to start it is necessary for pump assembly 10 to increase the pressure of oil in the flow passage 24 to a sufficiently high level to fire the injectors 12, despite the slow rotational speed and corresponding limited capacity of the high pressure pump. At this time, the inlet throttle valve is fully open and passages 128 open into passage 110. Oil from the oil pump 18 flows with minimum obstruction into the crank chamber and is pumped into passage 24.

The rotational speed of the diesel engine increases when the engine starts, to increase the pressure of the oil in passages 156 and 232. When pressure reaches a desired level as determined by current to solenoid 220, pilot relief valve 195 opens, allowing flow into passage 124 and chamber 125 and shifting of spool 112 to the left from the position shown in FIG. 12 to an operating position where large diameter openings 128 are closed and oil from pump 18 flows into the crank chamber through the small diameter passages 132–136 which open into inlet passage 110. Increased pressure in chamber 125 shifts the spool further to the left to a partially closed position in which the small diameter passages 132–134*a* have moved past the inlet opening 110 and passages 134*b*, 136*a*, 136*b* are partially open and only minimal flow of oil to the crank chamber is allowed.

Pressure shifting of spool 112 moves the flow control openings or holes 128–134*a* past inlet passage 110 to reduce the cross sectional flow area through valve 104 and reduce or throttle the volume of oil flowed into the crank chamber.

The lubricating oil in a cold diesel engine has a viscosity considerably higher than the viscosity of the oil heated to the normal operating temperature for the engine. When a cold diesel engine is started the viscosity of the oil can prevent the inlet throttle valve 104 from operating properly so that the diesel engine may be unstable and undrivable. Instability can be a problem when the engine is started at temperatures below about 15 degrees Fahrenheit. Instability decreases as the temperature of the engine increases and is not experienced when the temperature of the engine and engine oil are above 15 degrees Fahrenheit.

Temperature responsive valve 300 reduces low temperature engines instability. The temperature responsive member 306 in the valve opens passage 302 when the temperature of the engine is below about 15 degrees Fahrenheit and vents inlet throttle valve chamber 125 to the sump. Spring 120 holds spool 112 in the full open position shown in FIG. 12, independent of signals received from the electronic control module by valve 195 and flow through passage 124. With the inlet throttle valve fully open, a maximum flow of cold oil is supplied to crank chamber 36 through the inlet throttle valve and is flowed by pumps 74 to manifold 24. Excess oil in manifold 24 is returned to the sump through main stage mechanical relief valve 194. Flow of the oil through valve 194 reduces the pressure of the oil and releases heat to facilitate warming of the engine.

While pump assembly 10 is stable at temperatures above about 15 degrees Fahrenheit, the temperature responsive member 306 of valve 300 closes the valve in order to rapidly warm the diesel engine and reduce particulate and gaseous combustion products during warm up. Valve 300 may be closed by member 306 when the engine has warmed to a low operating temperature between 125 degrees Fahrenheit to 150 degrees Fahrenheit. Warming of the diesel engine continues until the desired operating temperature is reached, as determined by the close temperature of the thermostat for the cooling system.

When valve 300 is closed pump assembly 10 maintains the pressure of the oil in manifold 24 in response to current signals to solenoid 220 from the electronic control module. The signals are proportional to the desired instantaneous pressure in the high pressure outlet passage and manifold 24. Pump assembly 10 pumps a volume of oil slightly greater than the volume of oil required to maintain the desired instantaneous pressure in manifold 24. When the pressure in manifold 24 must be reduced quickly, excess high pressure oil is returned to the sump through valve 194. For instance, significant flow may have to be returned to the sump through valve 194 when the engine torque command is rapidly decreased.

When the engine is at a temperature in the normal operating range, a bleed flow of high pressure oil flows through restriction 206 and into chamber 232 at a reduced pressure and acts on the inner end of the main stage valve spool 204. When the pressure in passage 156 is increased sufficiently to cause a transient over pressure, the force exerted on the high pressure end of spool 204 by oil in high pressure passage 156 is greater than the force exerted on the low pressure end of the spool by spring 208 and the oil in chamber 232, and the spool shifts to the left as shown in FIG. 9 to open cross passages 210 and allow high pressure oil to flow through the crank shaft and back to sump 16, reducing the pressure in passage 156.

The solenoid force in pilot stage valve 195 is opposed by the pressure of oil in chamber 232 acting on the pin 228 over the area of the opening in seat 200. When the electronic control module requires an increase of pressure in the manifold 24 the current flow to solenoid 220 is increased to reduce the pilot flow of oil through valve 195, through orifice 219 and then through the shaft to the engine sump. Reduction of pressure in chamber 125 permits spring 120 to shift spool 112 to the right toward the open position as shown in FIG. 14. Oil expelled from chamber 125 flows through passage 124 into chamber 216, through orifice 219 and through the crankshaft to the engine sump.

Shifting of spool 112 toward the open position increases the flow openings leading into the crank chamber to correspondingly increase the volume of oil flowed into the crank chamber and pumped by the high pressure poppet valve pumps into manifold 24. The inlet throttle valve will open at a rate determined by the forces acting on spool 112. The pressure of the oil in bore 106 acting on the area of the spool and spring 120 bias the spool toward the open position. These forces are opposed by the pressure of the oil in chamber 125 acting on the area of the spool which biases the spool in the opposite direction. The spool moves toward the open position until a force balance or equilibrium position is established. When an equilibrium position of the spool is established, the pilot flow rate through bleed passage 219 is too low to develop a differential pressure across orifice 206 sufficient to shift spool 204 against spring 208 and open valve 194. Increased flow of pumped oil into the manifold increases the pressure of oil in the manifold.

If the main stage IPR valve 194 is closed when solenoid current is increased, valve 194 will remain closed. If the main stage valve 194 is partially open, the increase in solenoid current will partially close valve 195, increase the pressure in chamber 232 and close valve 194.

When the pressure of oil in manifold 24 is increased the pressure in chamber 232 will increase, pilot flow through passage 219 will resume and resulting pressure increase in chamber 125 will stop opening movement of the inlet throttle spool. If the inlet throttle spool overshoots the equilibrium position and the pressure of the oil in the manifold exceeds the commanded level, the main stage IPR valve 194 may open to flow oil from the manifold and reduce pressure in the manifold to the commanded level.

A sharp decrease in the solenoid current decreases the force biasing the valve pin 228 toward seat 200 to permit rapid increase in pilot flow and flow to inlet throttle valve chamber 125. The increased pressure on the closed end of the spool shifts the spool in a closing direction or to the left as shown in FIG. 12, reducing flow of oil into the crank chamber. The pumping chambers do not fill completely and output of high pressure oil flowed into the manifold is decreased.

Inlet throttle response may lag behind a step drop in solenoid current because of the time required to consume oil in the crank chamber when solenoid current is decreased. In this event, the opening of pilot valve 195 decreases the pressure in chamber 232 and the main stage IPR valve 194 opens to permit limited flow from the manifold to the sump and reduction of the pressure of the oil in the manifold.

During equilibrium operation of the warmed diesel engine, solenoid 220 receives an essentially constant amperage signal and pilot oil flows through valve 194 to chamber 214 through orifice 219 uniformly, but is influenced by pressure fluctuations from injection and piston pulsations. The resulting pressure in chamber 125, fed by passage 124, acts on the closed end of spool 112 and is opposed by the force of spring 120 and inlet pressure acting on spool 112. An equilibrium balance of forces occurs so that the flow of oil into the crank chamber is sufficient to maintain the desired pressure in manifold 24.

Inlet throttle controlled pump assembly 10 flows the required volume of engine oil into manifold 24 to meet HEUI injector requirements throughout the operating range of the diesel engine. During cold starting, when the engine is cranked by a starter, the inlet throttle valve is fully open and the high pressure check valve piston pumps 74 pump at full capacity to increase the pressure of the oil in the manifold to the starting pressure for the engine. During idling at a low speed of about 600 rpm with valve 300 closed, the spool in the inlet throttle valve is shifted to the closed position where only flow control openings 134*b*, 136*a* and 136*b* are partially open and a low volume of oil is pumped to maintain a low idle manifold pressure of 600 psi. If the minimum flow allowed by the inlet throttle spool is not utilized by the injectors, the main stage IPR valve 194 opens to allow the excess oil to return to the sump.

Pump assembly 10 flows the high pressure oil into manifold 24 and compression chamber 26, if provided. The high pressure oil is compressed sufficiently so that the flow requirements of the injectors 12 are met by expansion of the oil. The flow requirements for the injectors vary depending upon the duration of the electrical firing signal or injection event for the injectors. The control module may vary the timing of the injection event relative to top dead center of the engine piston, according to the desired operational parameters of the engine. The large volume of oil compressed by assembly 10 assures that a sufficient volume of compressed oil is always available for expansion whenever an injection event occurs, independent of the timing of the event signal.

Large volume manifolds and compression chambers increase the cost of diesel engines. The volume of the internal manifold may be reduced and an external chamber may be eliminated by providing the diesel engine with a HEUI pump assembly 10 having a number of high pressure pumps 74 sufficient to provide a high pressure pumping stroke during the occurrence of each injection event for each engine cylinder. For instance, the pumping stroke for each high pressure pump may be timed so that a sufficient volume of high pressure oil is flowed into a pressure line leading to the injectors when an injection event occurs so that a sufficient volume of pressurized pumped oil is available to fire the injector. As an example, assembly 10 includes four high pressure pumps 74 each having an approximately 180° pumping stroke with the strokes occurring one after the other during each rotation of crank shaft 40. The pump assembly could be mounted on an eight cylinder diesel engine with rotation of the assembly crank shaft timed so that output flow into a line leading to the injectors peaks when each ejector is fired. In this way, it is possible to provide a flow pulse in the line at the proper time and in a sufficient volume to fire the injectors, without the necessity of a large volume manifold or compression chamber. In other four stroke engines, one high pressure pump may pump oil during injection events for a pair of cylinders.

Control pump assembly 10 includes an inlet throttle valve and a hydraulic system, including electrically modulated valve 195, for controlling the inlet throttle valve to throttle inlet flow of oil to pump assembly 241 shown in FIG. 15. If desired, the hydraulic regulator may be replaced by an electrical regulator including a fast response pressure transducer mounted in high pressure outlet passage 156 to generate a signal proportional to the pressure in the passage, a comparator for receiving the output signal from the pressure transducer and a signal from the diesel engine electronic control module proportional to the desired pressure in the high pressure passage and for generating an output signal proportional to the difference between the two signals. The electrical system would also include an electrical actuator, typically a proportional solenoid, for moving the spool in the inlet throttle valve to increase or decrease flow of oil into the pump assembly 241 as required to increase or decrease the pressure in the high pressure passage. The electrical control system would include a pressure relief valve, like valve 194, to flow oil from passage 156 in response to transient overpressures and a mechanical relief valve like valve 168. The electrical regulator would control the output pressure as previously described.

Figure 16:
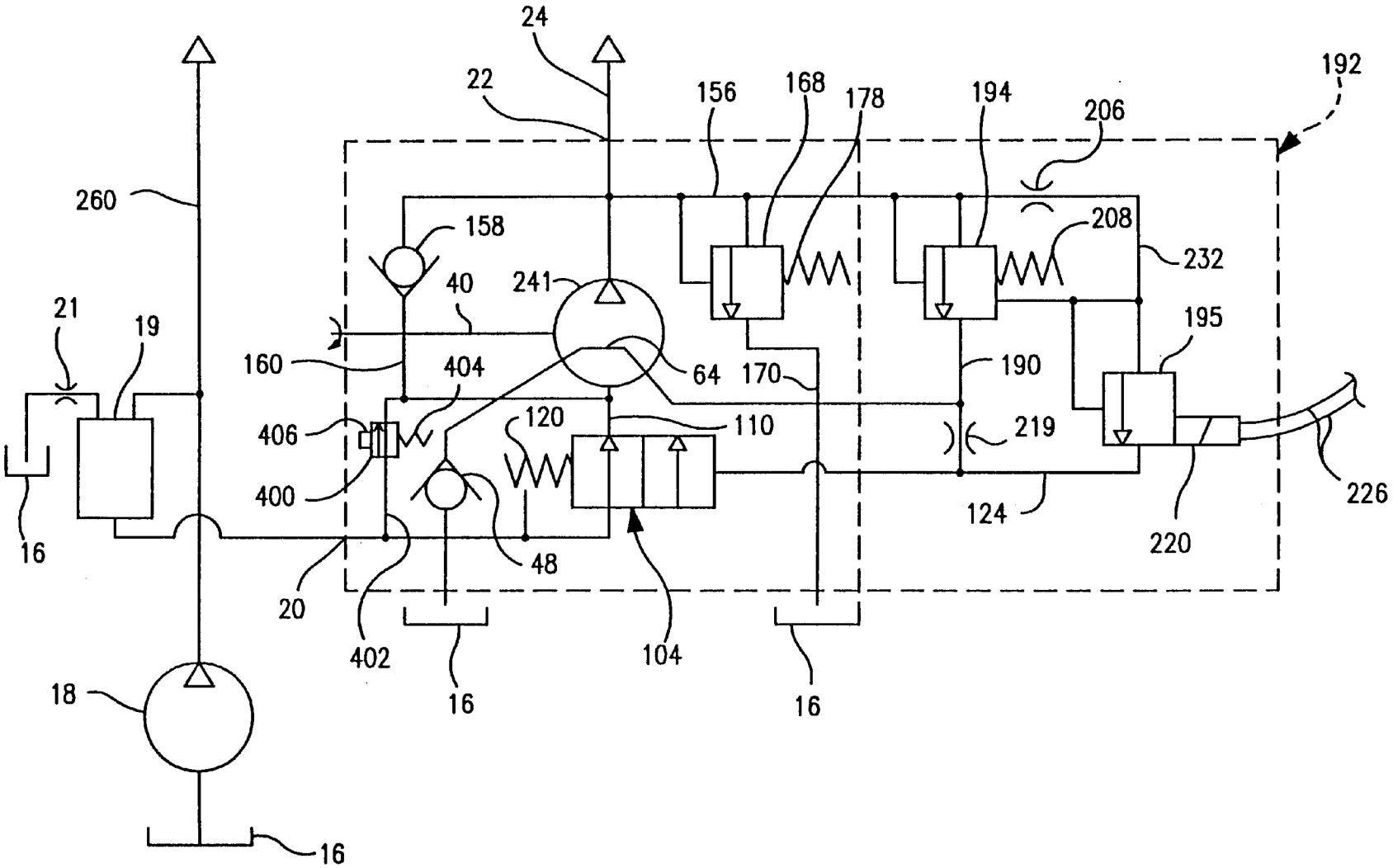
FIG. 16 is a diagram of the hydraulic circuitry of a second embodiment pump assembly.

FIG. 16 is a hydraulic circuit diagram for a second embodiment of the invention. The second embodiment is identical to the first embodiment with the exception that temperature responsive valve 300 and passage 302 are not provided and a temperature responsive valve 400 is located in a passage 402 in body 28 extending between inlet port 20 and oil inlet passage 110 leading to crank chamber 36. Passage 402 forms a direct connection between the inlet port 200 and crank chamber 36 bypassing inlet throttle valve 104.

Valve 400 is like valve 300 and includes a valving member (not illustrated) which is movable between a retracted position opening passage 402 and an extended position closing the passage. A spring 404 may be provided to hold the valving member in the open position. Temperature responsive member 406 moves the valving member between the retracted and extended positions and, like member 306 of first embodiment valve 300, maintains valve 400 open when the temperature of the diesel engine is below 15 degrees Fahrenheit. The temperature responsive member 406 may hold valve 400 closed until the temperature of the engine increases to about 125 to 150 degrees Fahrenheit, in order to assure rapid warm up of the engine and reduce gaseous and particulate combustion emissions.

When valve 400 is open oil supplied to inlet port 20 is flowed directly into the crank chamber 36 and bypasses the inlet throttle valve 104. Pump assembly 10 pumps available unthrottled oil from the crank chamber into the high pressure manifold to fire the diesel engine injectors. Excess high pressure oil is flowed back to the sump through the IPR valve. The pressure energy of the excess oil is converted to heat energy and aids in warming of the diesel engine, as previously described. When valve 400 is open the IPR valve will flow oil to chamber 125 of inlet throttle valve 104 and shift the spool in the valve in response to signals received from the electronic control module for the diesel engine. Oil may flow through the inlet throttle valve into the crank chamber. Instability of the inlet throttle valve because of viscosity of cold engine oil flowing through the valve does not affect operation of the diesel engine. Sufficient oil flows into the crank chamber through passage 402 for pumps 74 to maintain pressure requirements for firing the injectors.

Temperature responsive member 406 may be identical to temperature responsive member 306, previously described. Other actuators may shift the valve member in valve 400, as previously described.

Valves 300 and 400 include temperature responsive members which close the valve when the temperature of the diesel engine is above a reference temperature, which may be 15 degrees Fahrenheit. If desired, the temperature responsive member in either valve may be replaced by a timing circuit which keeps the valve open for an interval of time following cold start of the engine. The interval is sufficiently long to assure that the engine warms up to a reference temperature above about 15 degrees Fahrenheit and, preferably between 125 and 150 degrees Fahrenheit, as previously described. The timing circuit is deactivated for warm starts of the diesel engine where the engine is at a temperature above the reference temperature.

Pump assembly 10 is useful in maintaining the desired pressure of oil flowed to HEUI injectors in a diesel engine. The assembly may, however, be used for different applications. For instance, the pump may be rotated at a fixed speed and the inlet throttle valve used to control the pump to flow liquid at different rates determined by the position of the spool in the inlet throttle valve. The spool could be adjusted manually or by an automatic regulator. The pumped liquid could flow without restriction or could be pumped into a closed chamber with the pressure of the chamber dependent upon the flow rate from the chamber.

While I have illustrated and described preferred embodiments of my invention, it is understood that this is capable of modification, and I therefore do not wish to be limited to the precise details set forth, but desire to avail myself of such changes and alterations as fall within the purview of the following claims.

What is claimed is:

1. A pump assembly for pressurizing hydraulic fluid used to actuate electronically controlled hydraulic devices in an internal combustion engine having an electronic control; the pump assembly comprising a high pressure pump; a low pressure inlet port; a high pressure outlet port; a low pressure inlet passage extending from the low pressure inlet port to the high pressure pump; a high pressure outlet passage extending from the high pressure pump to the outlet port; an inlet throttle valve located in the low pressure passage, the inlet throttle valve including a valving member movable between a first position in which the low pressure passage is open to flow low pressure hydraulic fluid to the high pressure pump and a second position in which the inlet throttle valve is at least partially closed to restrict flow of hydraulic fluid to the high pressure pump; an inlet throttle valve regulator to move the valving member between the first and second positions in response to signals received from the electronic control; and a cold temperature inlet throttle valve deactivator to maintain the valving member in the first position independent of the inlet throttle regulator when the temperature of the internal combustion engine is below a reference temperature and to release the valving member for movement between the first and second positions when the temperature of the internal combustion engine is above the reference temperature, wherein during warm up of a cold internal combustion engine to the reference temperature the inlet throttle valve is open and available hydraulic fluid is flowed to the high pressure pump.

2. The pump assembly as in claim 1 wherein the valving member comprises a spool movable along a bore in the pump assembly, the spool having a closed end, the bore having an end, the end of the spool and the end of the bore defining a chamber; and a spring biasing the spool toward the end of the bore to reduce the volume of the chamber; said inlet throttle valve regulator including a source of hydraulic fluid and a regulator passage extending from the source to the chamber for flowing hydraulic fluid into the chamber to overcome the spring and move the spool away from the end of the bore; the cold temperature inlet throttle valve deactivator including a vent passage venting the chamber and a temperature responsive valve in the vent passage, the temperature responsive valve operable to open the vent passage when the temperature of the internal combustion engine is below the reference temperature and to close the vent passage when the temperature of the internal combustion engine is above the reference temperature.

3. The pump assembly as in claim 2 wherein said reference temperature is above about 15 degrees F.

4. The pump assembly as in claim 2 wherein the reference temperature is above about 125 degrees F.

5. The pump assembly as in claim 2 wherein said spool includes a cylindrical body, at least one flow opening extending through said cylindrical body, and the low pressure passage extends into the bore, along the interior of the cylindrical body, through the at least one flow opening and outwardly of the bore through an opening in the bore, wherein movement of the spool along the bore moves the at least one flow opening across said low pressure passage.

6. The pump assembly as in claim 2 wherein the inlet throttle regulator includes a regulator valve responsive to signals received from the electronic control, and including a first passage extending from the high pressure passage to the regulator valve.

7. The pump assembly as in claim 6 wherein the spool includes at least one large flow opening away from the end of the spool and a smaller flow opening adjacent the end of the spool.

8. The pump assembly as in claim 6 wherein flow control openings are spaced around the spool.

9. The pump assembly as in claim 6 wherein the vent passage joins the chamber.

10. The pump assembly as in claim 6 wherein the reference temperature is above about 15 degrees F.

11. The pump assembly as in claim 6 wherein the reference temperature is above about 150 degrees F.

12. The pump assembly as in claim 6 wherein the regulator valve comprises a solenoid controlled valve, and including an electrical connection between the electronic control and the solenoid controlled valve.

13. The pump assembly as in claim 1 wherein the inlet throttle valve deactivator includes a timing circuit to keep the valving member in the first position during an interval after a cold start of the internal combustion engine.

14. The pump assembly as in claim 13 wherein the interval is about three minutes.

15. A pump assembly for pressurizing hydraulic fluid used to actuate electronically controlled hydraulic devices in an internal combustion engine having an electronic control; the pump assembly comprising a high pressure pump; a low pressure inlet port; a high pressure outlet port; a low pressure inlet passage extending from the low pressure inlet port to the high pressure pump; a high pressure outlet passage extending from the high pressure pump to the outlet port; an inlet throttle valve located in the low pressure passage, the inlet throttle valve including a valving member movable between a first position in which the low pressure passage is open to flow low pressure hydraulic fluid to the high pressure pump and a second position in which the inlet throttle valve is at least partially closed to restrict flow of hydraulic fluid to the high pressure pump; an inlet throttle valve regulator to move the valving member between the first and second positions in response to signals received from the electronic control; a bypass passage extending around the inlet throttle valve and joining the low pressure passage to either side of the inlet throttle valve; a bypass valve in the bypass passage; and a bypass valve operator to open the bypass valve when the temperature of the internal combustion engine is below a reference temperature and to close the bypass passage when the temperature of the internal combustion engine is above the reference temperature; wherein during warm up of a cold internal combustion engine the bypass passage is open to flow available hydraulic fluid to the high pressure pump.

16. The pump assembly as in claim 15 wherein said bypass valve operator comprises a temperature responsive member.

17. The pump assembly as in claim 16 wherein said reference temperature is above about 15 degrees F.

18. The pump assembly as in claim 16 wherein the reference temperature is above about 125 degrees F.

19. The pump assembly as in claim 15 wherein said bypass valve operator includes a timing circuit to open the bypass valve during an interval after cold start up of the internal combustion engine.

20. The pump assembly as in claim 19 wherein the interval is about three minutes.

21. The method of operating an internal combustion engine having hydraulic devices which are actuated during operation of the engine, an electronic control module, a high pressure pump assembly for pressurizing hydraulic fluid to actuate the devices, an inlet throttle valve regulator responsive to signals from the electronic control module and to the output pressure of the high pressure pump assembly, and an inlet throttle valve to control the flow of hydraulic fluid supplied to the high pressure pump in response to input from the inlet throttle regulator, and a control connection between the inlet throttle valve regulator and the inlet throttle valve, comprising the steps of:

A) when the temperature of the internal combustion engine is below a reference temperature:
   i) deactivating the control connection between the inlet throttle valve regulator and the inlet throttle valve, and
   ii) holding the inlet throttle valve open; and B) when the temperature of the internal combustion engine is above the reference temperature:
   i) maintaining the control connection between the inlet throttle valve regulator and the inlet throttle valve, and
   ii) opening and closing the inlet throttle valve in response to input from the inlet throttle valve regulator.

22. The method of claim 21 wherein the inlet throttle valve includes a bore in the pump assembly, the bore having a closed end, a spool in the bore, the spool having a closed end adjacent the closed end of the bore, a pressure chamber located in the bore between the closed end of the spool and the end of the bore, and a spring biasing the spool toward the closed end of the bore to open the inlet throttle valve, and the control connection comprising a hydraulic passage extending from the inlet throttle valve regulator to the chamber, including the step of:

C) when the temperature of the internal combustion engine is below the reference temperature:
   i) venting the chamber so that the spring moves the spool towards the closed end of the bore to open the inlet throttle valve.

23. The method of operating an internal combustion engine having hydraulic devices which are actuated during operation of the engine, an electronic control module, a high pressure pump assembly for pressurizing hydraulic fluid to actuate the devices and an inlet throttle valve to control the flow of hydraulic fluid supplied to the high pressure pump through an inlet passage in response to input from the electronic control module, and a bypass passage extending around the inlet throttle valve and joining the inlet passage to either side of the inlet throttle valve, comprising the steps of:

A) opening said bypass passage to flow hydraulic fluid to the high pressure pump assembly through the bypass passage when the temperature of the internal combustion engine is below a reference temperature; and B) Closing the bypass passage to flow hydraulic fluid to the high pressure pump assembly through the inlet throttle valve when the temperature of the internal combustion engine is above a reference temperature.

24. The method of claim 23 including the steps of:

C) Opening the bypass valve during an interval after cold start up of the internal combustion engine; and D) Closing the bypass valve after said interval.

25. The method of claim 23 including the steps of:

C) Opening the bypass passage when the temperature of the internal combustion engine is below about 15 degrees F.; and D) Closing the bypass passage when the temperature of the internal combustion engine is above about 15 degrees F.

* * * * *